US010364942B2

(12) United States Patent
Nozawa

(10) Patent No.: US 10,364,942 B2
(45) Date of Patent: Jul. 30, 2019

(54) HONEYCOMB STRUCTURAL HIGH-PRESSURE SET TANK AND A MANUFACTURING PROCESS THEREFOR

(71) Applicant: Tsukasa Nozawa, Tokyo (JP)

(72) Inventor: Tsukasa Nozawa, Tokyo (JP)

( * ) Notice: Subject to any disclaimer, the term of this patent is extended or adjusted under 35 U.S.C. 154(b) by 328 days.

(21) Appl. No.: 15/070,354

(22) Filed: Mar. 15, 2016

(65) Prior Publication Data

US 2017/0268728 A1 Sep. 21, 2017

(51) Int. Cl.

| | |
|---|---|
| ***F17C 13/08*** | (2006.01) |
| ***F17C 13/00*** | (2006.01) |
| ***B65D 90/20*** | (2006.01) |
| ***F17C 1/16*** | (2006.01) |
| ***F17C 1/00*** | (2006.01) |

(52) U.S. Cl.

CPC ..... *F17C 13/084* (2013.01); *B65D 90/20* (2013.01); *F17C 1/00* (2013.01); *F17C 1/16* (2013.01); *F17C 13/002* (2013.01); *F17C 2201/0104* (2013.01); *F17C 2201/0109* (2013.01); *F17C 2201/0138* (2013.01); *F17C 2201/032* (2013.01); *F17C 2201/035* (2013.01); *F17C 2205/0107* (2013.01); *F17C 2205/0111* (2013.01); *F17C 2205/0115* (2013.01); *F17C 2205/0134* (2013.01); *F17C 2205/0138* (2013.01); *F17C 2205/0332* (2013.01); *F17C 2205/0394* (2013.01); *F17C 2223/036* (2013.01)

(58) Field of Classification Search

CPC .. F17C 13/084; F17C 1/00; F17C 1/16; F17C 13/002; F17C 2201/0104; F17C 2201/0109; F17C 2201/0138; F17C 2201/032; F17C 2201/035; F17C 2205/0107; F17C 2205/0111; F17C 2205/0115; F17C 2205/0134; F17C 2205/0138; F17C 2205/0332; F17C 2205/0394; F17C 2223/036; B65D 90/20; B65D 2577/042; G21F 5/008; G21F 5/005; G21F 5/012; G21C 19/07; G21C 19/40

USPC ... 220/581, 582.584, 586–592, 23.87, 23.88, 220/23.89; 376/272; 250/270.1, 506.1, 250/507.1; 206/443, 446

See application file for complete search history.

(56) References Cited

U.S. PATENT DOCUMENTS

| | | | | |
|---|---|---|---|---|
| 3,537,416 | A | 11/1970 | Cowles | |
| 3,641,230 | A | 2/1972 | Jenks | |
| 4,063,999 | A | 12/1977 | Wade | |
| 4,476,988 | A | 10/1984 | Tanner | |
| 5,174,466 | A * | 12/1992 | Matyja ..... | B65D 90/046 220/62.21 |
| 6,638,348 | B2 | 10/2003 | Kuriiwa et al. | |
| 8,006,841 | B2 | 8/2011 | Bontemps et al. | |
| 8,917,809 | B2 | 12/2014 | Nozawa | |

(Continued)

FOREIGN PATENT DOCUMENTS

| | | |
|---|---|---|
| JP | 2001-287290 | 10/2001 |
| WO | 01/57354 A2 | 8/2001 |
| WO | 2010/057089 A1 | 5/2010 |

*Primary Examiner* — Andrew D Perreault

(74) *Attorney, Agent, or Firm* — Juan Carlos A. Marquez; Marquez IP Law Office, PLLC

(57) ABSTRACT

The present invention is directed to a new concept for a large-scale high-pressure Honeycomb Set Tank in an ISO container and for its manufacturing facilities. A process for manufacturing a plurality of honeycomb cells with a high degree of accuracy is also provided.

9 Claims, 15 Drawing Sheets

(56) References Cited

U.S. PATENT DOCUMENTS

| | | | | |
|---|---|---|---|---|
| 2003/0201062 | A1* | 10/2003 | Miyazaki | B31D 5/04 156/211 |
| 2004/0145079 | A1 | 7/2004 | Lin et al. | |
| 2010/0051624 | A1* | 3/2010 | Finn | B63B 27/24 220/560 |
| 2013/0224410 | A1* | 8/2013 | Nozawa | B29C 70/342 428/35.7 |

* cited by examiner

HONEYCOMB STRUCTURAL HIGH-PRESSURE SET TANK AND A MANUFACTURING PROCESS THEREFOR

BACKGROUND OF THE INVENTION

Field of the Invention

This invention is concerned with a large-scale high-pressure gasholder in which a plurality of internal tanks have been accumulated in a honeycomb structure.

Description of the Prior Art

U.S. Pat. No. 8,917,809 B2 shows the idea of the large-scale high-pressure gasholder accumulated in the honeycomb structure. However, "U.S. Pat. No. 8,917,809 B2" needs some supplemental technologies when actually manufacturing it.

Problems the Invention is Solving

It is not so difficult to manufacture a single internal tank of 750 atmospheric pressures. However, there are two big problems. First, it is difficult to uniformly heat a plurality of internal tanks accumulated in the honeycomb structures with heating oven. The second is the size accuracy of hexagon pillars is difficult to achieve because the pillars are encompassed by thermosetting prepreg.

When the specification of a large-scale high-pressure gasholder is 750 atmospheric pressures, a ten-foot container size and a total capacity of 3000 liters or more, the number of internal tanks becomes about 60 pieces.

Each internal tank is reinforced by a plurality of thermosetting prepreg plies and is accumulated into a mass structure. The internal tank reinforced by the thermosetting prepreg does not have structural strength, if it is not heated & pressurized. Therefore, it is necessary that all internal tanks are heated and pressurized at identical terms.

By connecting of all internal tanks continuously, all internal tanks can be pressurized by the same internal pressure. However, it is impossible to heat all internal tanks, which are accumulated in ten-foot container, at identical terms by the oven method. The oven method is shown in "U.S. Pat. No. 8,917,809 B2".

Another problem is that the thermosetting prepreg is soft and sticky cloth at room temperature. Thus, it is impossible to manufacture the hexagon pillars of honeycomb cell that are covered with thermosetting prepreg with precise accuracy.

Even if the external size of hexagon pillars is inaccurate, when the external size of a honeycomb cell is made small, the honeycomb structure can be made because hexagon pillars expand from inside. However, the position of the Connection Ports of the internal tanks shifts slightly with each other when a honeycomb structure is built by a plurality of hexagon pillars whose external sizes are not accurate. As a result, the work to connect each flange continuously needs long working time. When working hours becomes long, the work becomes more and more difficult because the adhesive of the thermosetting prepreg begins to melt.

SUMMARY OF THE INVENTION

The new invention described herein is directed to improving the structure and operation of the device disclosed in U.S. Pat. No. 8,917,809 B2.

It is not so difficult to manufacture a single internal tank of 750 atmospheric pressures. An example is outlined hereinbelow:

1. High-pressure internal tank is manufactured from plastic cylindrical tank reinforced by carbon fiber.

2. Cylindrical tank with reinforced by carbon fiber
   (A) Cylindrical tank

| | |
|---|---|
| ① Inside diameter [Di]: | 216 (mm) |
| ② Total length [Li]: | 1850 (mm) |
| ③ Thickness of reinforcement [t]: | 5.0 (mm) |

(B) Reinforcement material

| | |
|---|---|
| ① Material: Carbon fiber | |
| ② Product name: ダイアリード : | K13D2U (Mitsubishi Plastics Industries) |
| ③ Working stress: | 3700 (MPa) |

3. Design pressure
   (A) Design pressure

| | |
|---|---|
| ① Engineering system of units [P]: | 1000 (atmospheric pressure) |
| ② SI unit system [P]: | 98.1 (MPa) |

4. Hoop stress
   (A) Hoop stress[σ] is a stress which works at the direction of the surroundings. Axis stress is half of the hoop stress.
   (B) σ=Di*P/2 t
   ① Di=216 (mm)
   ② P=98.1 (MPa)
   ③ t=5.0 (mm)
   ④ σ=216 (mm)*98.1 (MPa)/2*5.0 (mm)=2119 (MPa)
   ⑤ Hoop stress[σ] is smaller than the working stress of K13D2U (Mitsubishi Plastics industries).
   (C) Therefore, the cylindrical tank reinforced by K13D2U (Mitsubishi Plastics Industries) of 5.0 m in thickness has resisting pressure strength more than 1000 atmospheric pressures. The limit pressure of the cylindrical tank is about 1800 atmospheric pressures.
   (D) Note: The length of the tank is not included in the calculation of the hoop stress.

These internal tanks are arranged in a honeycomb shape in a ten-foot container. Total capacity is calculated as follows:

1. When the internal tanks are arranged in a honeycomb shape in a ten-foot container, these tanks are designed in sets of 59 pieces.
2. Capacity of the internal tank of inside diameter 210 (mm) and the length 1850 (mm)
   (A) Body length of internal tank (L)
   ① L=1850 (mm)−210 (mm)=1640 (mm)
   (B) Body capacity of internal tank (V1)
   ① V1=π*105 (mm)*105 (mm)*1640 (mm)=56,803,137 (mm^3)=56.8 (liter)
   (C) Capacity of globe of internal tank (V2)
   ① V2=(¾)*π*105 (mm)*105 (mm)*105 (mm)=4,849,048 (mm^3)=4.8 (liter)
   (D) Capacity of internal tank (V)
   ① V=V1+V2=56.8 (liter)+4.8 (liter)=61.6 (liter)
3. Total capacity of the ten-foot container tank (VT)
   (A) VT=V*59=61.6 (liter)*59=3,634 (liter)
4. Total capacity of the ten-foot container tank is about 3,600 (liter).

It is not so difficult to manufacture a single internal tank of 750 atmospheric pressures using the method of U.S. Pat. No. 8,917,809 B2. The internal tank is manufactured from a plastic cylindrical tank reinforced by thermosetting carbon fiber prepreg. The thickness of the carbon fiber prepreg, when the inside diameter 210 (mm), is about 5.0 mm. The thermosetting carbon fiber prepreg wrapped around the plastic tank is stiffened at about 130° C. by pressurizing the tank from the inside and outside. An air compressor is used for pressurizing inside the tank. Heat foam resin is used for pressurizing the outside of the tank. The heat oven is used to heat the tank. The internal pressure of the tank is preferably set to be about 20 atmospheric pressures.

However, it is not easy to heat and pressurize a plurality of internal tanks uniformly, which are being accumulated in the ten-foot container, by using a heating oven. The internal tanks in the center part of the container cannot be heated enough if the heating oven is used to heat them. To solve this problem, a new method for heating and pressurizing a plurality of internal tanks is being provided which will be described in detail hereinbelow.

Another problem is that the thermosetting prepreg is soft and sticky cloth at room temperature. According to U.S. Pat. No. 8,917,809 B2, the honeycomb cell is manufactured by wrapping the hexagon pillar made of heat foam resin with thermosetting prepreg. The thermosetting prepreg is soft and sticky cloth at room temperature. It is impossible to manufacture a honeycomb cell with precise accuracy using this method. There is no obstacle in manufacturing the honeycomb structure because the heat foam resin expands even if there are some error margins in the size of the honeycomb cell. However, by this method, it is difficult to control the position of connected flanges of an internal tank, which exists in the honeycomb cell. Additionally, the honeycomb cell walls are manufactured from thermosetting prepreg which needs be kept at minus 5° C. in the freezer prior to use.

The internal tank is placed in the honeycomb cell. When a honeycomb structure is built by a lot of honeycomb cells whose externals sizes are not accurate, the position of the Connection Ports of the internal tanks shift slightly. A lot of internal tanks are connected into a line. However, the material of piping which connects a lot of internal tanks is not soft like man's large intestines. Therefore, when the positions of the internal tank Connection Ports are not constant, the work of connection becomes difficult. As a result, the work to connect each flange continuously needs a long working time. When working hours becomes long, the work becomes difficult more and more because the adhesive of thermosetting prepreg begins to melt.

To solve this problem, new type prepreg which is made from the thermoplastic resin is adopted. Thermoplastic prepreg is a solid and flat board in the room temperature as well as the aluminum board. As for thermoplastic prepreg, press working is possible though a moderate level of heating. The processing accuracy of thermoplastic prepreg by press working is excellent as well as using aluminum. The parts made of thermoplastic prepreg with press working do not have cohesiveness at room temperature. The parts manufactured from thermoplastic prepreg soften at about 100° C., and are merged at about 130° C. Therefore, when board material A and board material B, which are manufactured from thermoplastic prepreg, are pressed with moderate pressure and heated to about 130° C., the board material A and board material B are completely merged together.

Thermoplastic prepreg can be formed as a solid and flat board at room temperature in combination with an aluminum board. Honeycomb cell walls manufactured from thermoplastic prepreg need not be kept at minus 5° C. in the freezer. Therefore, there is no obstacle in work no matter how the assembly time of the honeycomb structure made from thermoplastic prepreg becomes long. Also, the honeycomb cell manufactured from thermoplastic prepreg is excellent in the size accuracy. As for the work to manufacture the honeycomb structure by combining a lot of honeycomb cells, the thermoplastic prepreg is excellent compared with thermosetting prepreg.

Additionally, in this invention, the outside wall of the honeycomb cell is divided into two parts. The outside walls of the honeycomb cell, which is divided into two parts, expand independently when heat form resin in the honeycomb expands by heat. Therefore, the shape of the honeycomb cells in the honeycomb structure is not distorted by heat form expansion.

BRIEF DESCRIPTION OF THE DRAWINGS

FIG. 4(A) shows a concept chart of an Internal Tank (31) using the references of (29) Reinforced Tank, and (30) Connection Port.

FIG. 4(B) shows a concept chart of an Internal Tank with Height Adapter (33) using the references of (31) Internal Tank and (32) Height Adaptor.

FIG. 4(C) shows a processing chart of a Pentagon Foam Resin using the references of (33) Internal Tank with Height Adapter, (34) Quadrangle Foam Resin and (35) Hexagon Foam Resin.

FIG. 4(D) shows a concept chart of a Pentagon Foam Resin with Internal Tank (36) using the references of (33) Internal Tank With Height Adapter, (34) Quadrangle Foam Resin and (35) Hexagon Foam Resin.

FIG. 4(E) shows a processing chart of a Pentagon Cell Tank using the references of (36) Pentagon Foam Resin with Internal Tank, (37) Quadrangle Prepreg and (38) Hexagon Prepreg.

FIG. 4(F) shows a concept chart of a Pentagon Cell Tank (40) using the references of (36) Pentagon Foam Resin with Internal Tank, (37) Quadrangle Prepreg, (38) Hexagon Prepreg and (39) Connection Cutting Lack.

FIG. 5(A) shows a concept chart of an Internal Tank (43) using the references of (41) Reinforced Tank, and (42) Connection Port.

FIG. 5(B) shows a concept chart of an Internal Tank with Height Adapter (45) using the references of (43) Internal Tank and (44) Height Adaptor.

FIG. 5(C) shows a processing chart of a Hexagon Foam Resin with Internal Tank using the references of (45) Internal Tank with Height Adapter and (46) Hexagon Foam Resin.

FIG. 5(D) shows a concept chart of a Hexagon Foam Resin with Internal Tank (47) using the references of (45) Internal Tank With Height Adapter and (46) Hexagon Foam Resin.

FIG. 5(E) shows a processing chart of a Hexagon Cell Tank using the references of (47) Hexagon Foam Resin with Internal Tank and (48) Hexagon Prepreg.

FIG. 5(F) shows a concept chart of a Hexagon Cell Tank (50) using the references of (47) Hexagon Foam Resin With Internal Tank, (48) Hexagon Prepreg and (49) Connection Cutting Lack.

FIG. 8(A) and FIG. 8(B) shows a concept chart of a Container Wall Assembly (66) using the references of (60) Bottom Wall, (61) Top Wall, (62) Rear Wall, (63) Front Wall, (64) Left Side Wall and (65) Right Side Wall.

FIG. 9(A) and FIG. 9(B) shows a processing chart of a Container Honeycomb Cell using the references of (67) Bottom Wall, (68) Rear Wall, (69) Left Side Wall, (70) Rear Cushion Wall, (71) Left Side Cushion Wall, (72) Pentagon Honeycomb Cell, (73) Hexagon Honeycomb Cell and (74) Trapezoid Filler.

FIG. 10(A) and FIG. 10(B) show a concept chart of a Container Honeycomb Cell (87) using the references of (75) Bottom Wall, (76) Rear Wall, (77) Front Wall, (78) Left Side Wall, (79) Right Side Wall, (80) Rear Cushion Wall, (81) Front Cushion Wall, (82) Left Side Cushion Wall, (83) Right Side Cushion Wall, (84) Pentagon Honeycomb Cell, (85) Hexagon Honeycomb Cell and (86) Trapezoid Filler.

FIG. 11(A) and FIG. 11(B) show a processing chart of a Container Honeycomb Cell Tank With Height Adapter (91) using the reference of Container Honeycomb Cell (88), Internal Tank (89) and Height Adapter (90).

FIG. 12(A) and FIG. 12(B) show a processing chart of a Container Honeycomb Cell Tank Top Piping (98) using the reference of Internal Tank (92), Pentagon Honeycomb Cell (93), Hexagon Honeycomb Cell (94), Height Adapter (95), Shut Off Valve (96) and Top Piping (97).

FIG. 13(A) and FIG. 13(B) show a concept chart of a Honeycomb Container Tank With Piping (114) using the reference of, Internal Tank (99), Pentagon Honeycomb Cell (100), Hexagon Honeycomb Cell (101), Cushion Wall (102), Bottom Wall (103), Top Wall (104), Rear Wall (105), Front Wall (106), Left Side Wall (107), Right Side Wall (108), Shut Off Valve (109), Top Piping (110), Bottom Piping (111), Entrance Connection (112) and Exit Connection (113).

FIG. 14(A) and FIG. 14(B) shows a concept chart of a Reinforcement Frame Device (121) using the references of (115) Bottom Frame, (116) Top Frame, (117) Rear Frame, (118) Front Frame, (119) Left Side Frame and (120) Right Side Frame.

FIG. 15(A) and FIG. 15(B) shows a concept chart of a High-Pressure Container Tank (134) using the references of (122) Container Wall, (123) Container Base Palette, (124) Pentagon Honeycomb Cell, (125) Hexagon Honeycomb Cell, (126) Trapezoid Filler, (127) Cushion Wall, (128) Internal Tank, (129) Shut Off Valve, (130) Internal Tank Piping, (131) Entrance Connection, (132) Exit Connection and (133) Control Board.

DESCRIPTION OF THE PREFERRED EMBODIMENT

The embodiments of the present invention will be described hereinbelow in conjunction with the above-described drawings. Referring to the attached drawings as follows, a concrete execution of the manufacturing process of a large-scale high-pressure gasholder in which a plurality of internal tanks have been accumulated in honeycomb structure is explained.

Figure 1:
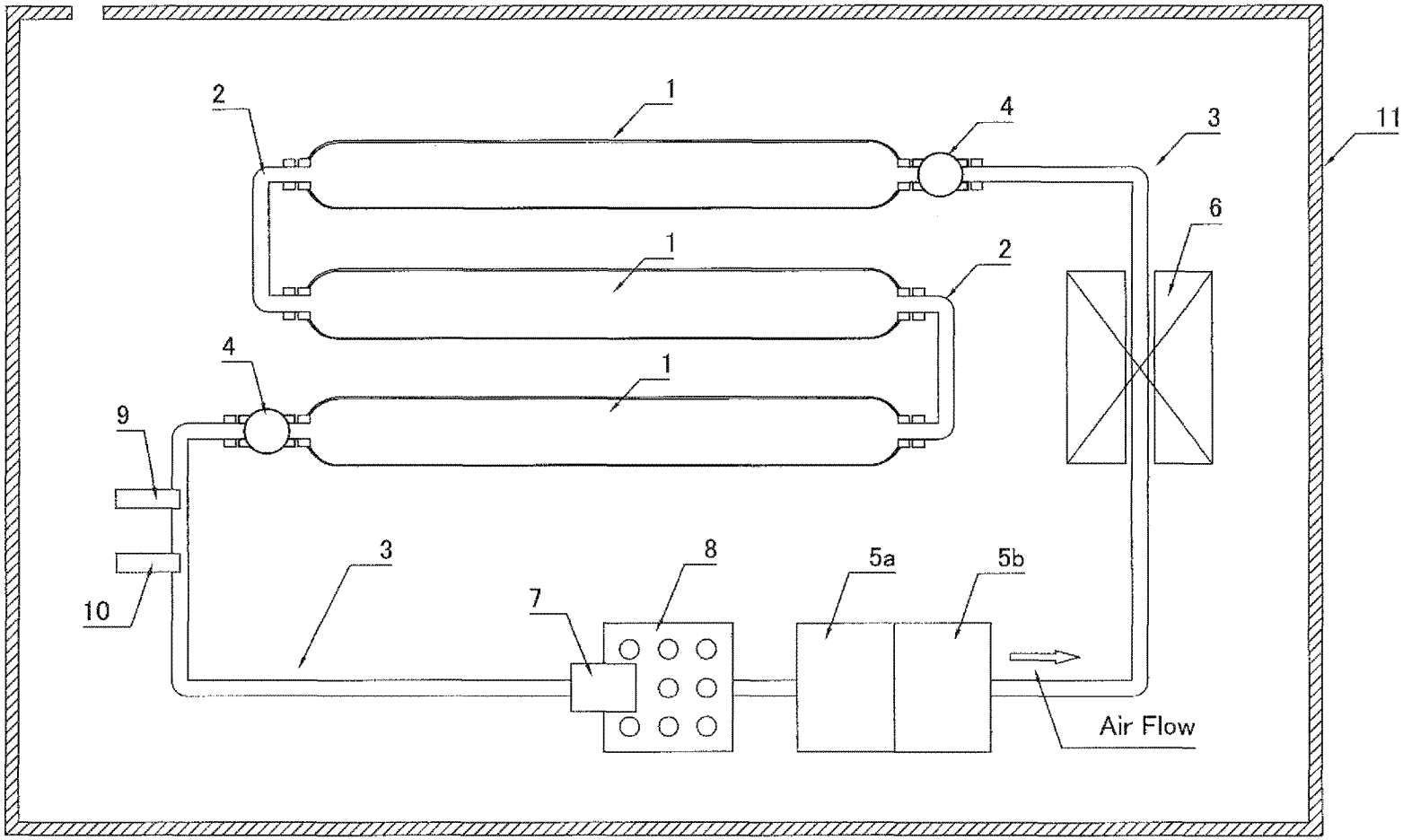
FIG. 1 shows a concept chart of a heating and pressurizing system for a plurality of internal tanks using the references of (1) Internal Tank, (2) Internal Connection Pipe, (3) External Piping System, (4) Shut Off Valve, (5*a*) Air Compressor, (5*b*) Accumulator, (6) Electric Heater, (7) Flow Control Valve, (8) Discharge Tank, (9) Thermometer, (10) Pressure Gauge and (11) Heating Oven.

FIG. 1 shows a concept chart of a Heating and Pressurizing System for a plurality of internal tanks. The Heating and Pressurizing System for a plurality of internal tanks is composed of Internal Tanks (1), Internal Connection Pipes (2), External Piping System (3), Shut Off Valves (4), (5*a*) Air Compressor, (5*b*) Accumulator, Electric Heater (6), Flow Control Valve (7), Discharge Tank (8), Thermometer (9), Pressure Gauge (10) and Heating Oven (11).

Each Internal Tank (1) is manufactured from plastic cylindrical tank reinforced by thermosetting carbon fiber prepreg. The Internal Tank (1) has two connection ports in it. A plurality of Internal Tanks (1) are connected in series by these connection ports. Internal Connection Pipes (2) continuously connect the Internal Tanks (1). The Internal Connection Pipes (2) are made of stainless steel.

External Piping System (3) is composed of Shut Off Valve (4), (5*a*) Air Compressor, (5*b*) Accumulator, Electric Heater (6), Flow Control Valve (7), Discharge Tank (8), Thermometer (9) and Pressure Gauge (10). Two Shut Off Valves (4) have adhered to the entrance and the exit of the External Piping System (3).

External Piping System (3) is pressurized and heated by Air Compressor (5*a*) and Electric Heater (6), Accumulator (5*b*) controls the pressure fluctuation of compress air. Air Compressor (5*a*) pressurizes a line of Internal Tanks (1)

connected with the External Piping System (3), However, Electric Heater (6) cannot heat a plurality of Internal Tanks (1) at the same time because the Electric Heater (6) is only partially heating compressed air in External Piping System (3). It is necessary to make the compressed air heated by Electric Heater (6) circulate to heat Internal Tank (1).

Flow Control Valve (7) is attached to the External Piping System (3). The External Piping System (3) ends at Flow Control Valve (7); thus the compressed air of the External Piping System (3) is discharged into Discharge Tank (8). The Discharge Tank (8) is at atmospheric pressure. Compressed air discharged into the Discharge Tank (8) is decompressed to atmospheric pressure, and inputted from the entrance of the Air Compressor (5*a*). Thus, the compressed air heated by the Electric Heater (6) circulates in a line of Internal Tanks (1) and through the External Piping System (3).

Thermometer (9) and Pressure Gauge (10) are mounted along External Piping System (3) to measure temperature and pressure, Heating Oven (11) heats the entire container from the outside of the container. The inside of Heating Oven (11) is at one atmospheric pressure. The system for heating and pressurizing Internal Tanks (1) is placed in Heating Oven (11). When a heatproof performance of Air Compressor (5*a*) is insufficient, Air Compressor (5*a*) may be implemented outside of the oven.

A line of Internal Tanks (1) are pressurized statically when Air Flow Control Valve (7) is not open. It is easy to pressurize the inside of Internal Tanks (1) to about 20 atmospheric pressures with Air Compressor (5*a*). When Air Flow Control Valve (7) is opened, compressed air bleeds from Air Flow Control Valve (7). However, when the flowing quantity of Air Compressor (5*a*) is large enough, the inside pressure of the Internal Tanks (1) can be kept about 20 atmospheric pressures, because Air Flow Control Valve (7) controls the amount of the bleed air.

After heat treatment process, Shut Off Valves (4) are closed. The thermosetting carbon fiber prepreg layers melt at about 130° C., and are merged mutually at that temperature. However, it is impossible that FRP made from the thermosetting carbon fiber prepreg obtains structural strength when FRP structure is not cooled enough. Therefore, internal pressure of the Internal Tanks (1) cannot be lowered until the Internal Tanks (1) get cold enough. When the Shut Off Valves (4) are shut, the container tank can be taken out from Heating Oven (11) with the internal pressure of the Internal Tanks (1) maintained. The Manufacturing operation effect improves because the container tank may be cooled outside of the Heating Oven (11).

Figure 2:
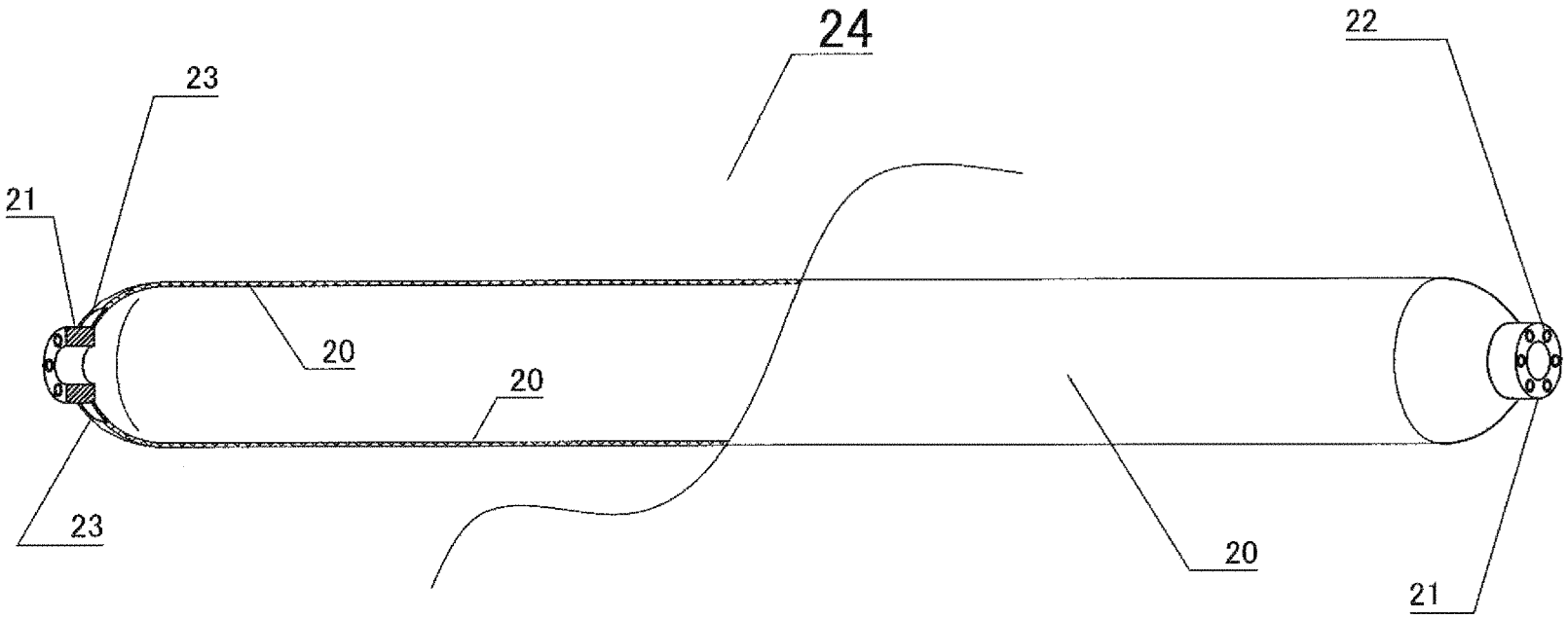
FIG. 2 shows a concept chart of an Internal Plastic Tank (24) using the references of (20) Plastic Tank, (21) Connection Port, (22) Screw Hole and (23) Domed Wing.

FIG. 2 shows a concept chart of an Internal Plastic Tank (24) that is composed of Plastic Tank (20) and Connection Port (21). Plastic Tank (20) is a cylindrical tank manufactured from plastic and it has two Connection Ports (21) at top and bottom. Connection Port (21) is made of stainless steel. Connection Port (21) has one penetrating hole, and a plurality of Screw Holes (22) for attachment. Plastic Tank (20) and two Connection Ports (21) are built in one body. The connection port (21) has a Domed Wing (23) at the bottom of the Connection Port (21). Therefore, Connection Port (21) is prevented from being pushed out from Plastic Tank (20) by internal pressure.

Figure 3:
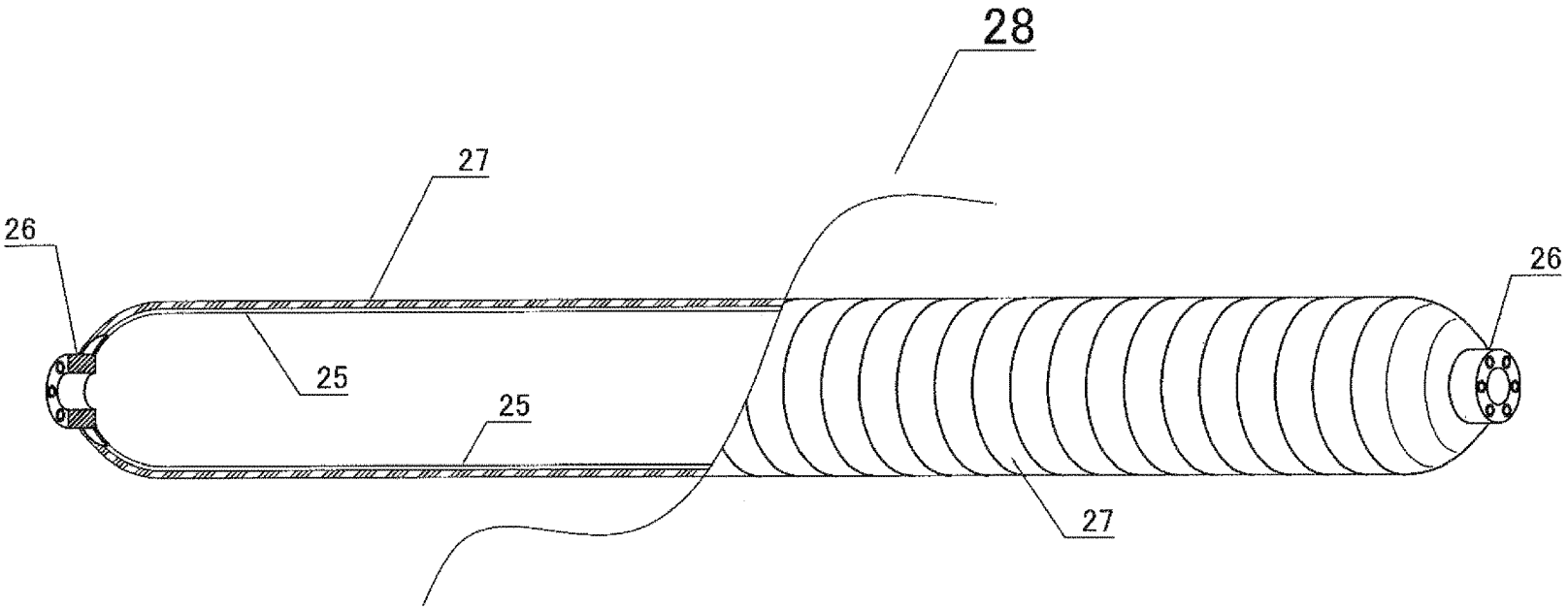
FIG. 3 shows a concept chart of an Internal Tank (28) using the references of (25) Plastic Tank, (26) Connection Port, and (27) Reinforcement FRP Prepreg.

FIG. 3 shows a concept chart of an Internal Tank (28). Internal Tank (28) is composed of a Plastic Tank (25), a Connection Port (26), and Reinforcement FRP Prepreg (27). The Plastic Tank (25) is a cylindrical tank manufactured from plastic and it has two Connection Ports (26) at the top and bottom. Plastic Tank (25) is reinforced with Reinforcement FRP Prepreg (27). Reinforcement FRP Prepreg (27) is made from thermosetting carbon fiber prepreg. The Plastic Tank (25) can be easily reinforced, because thermosetting prepreg is a soft and sticky cloth at room temperature. Internal Tank (28) is kept in the freezer at minus 5° C. or less to prevent deterioration of the thermosetting prepreg.

FIG. 4(A), FIG. 4(B), FIG. 4(C), FIG. 4(D), FIG. 4(E) and FIG. 4(F) show the manufacturing process chart of a Pentagon Cell Tank (40).

Figures 4A, 4B, 4C, 4D, 4E, 4F:
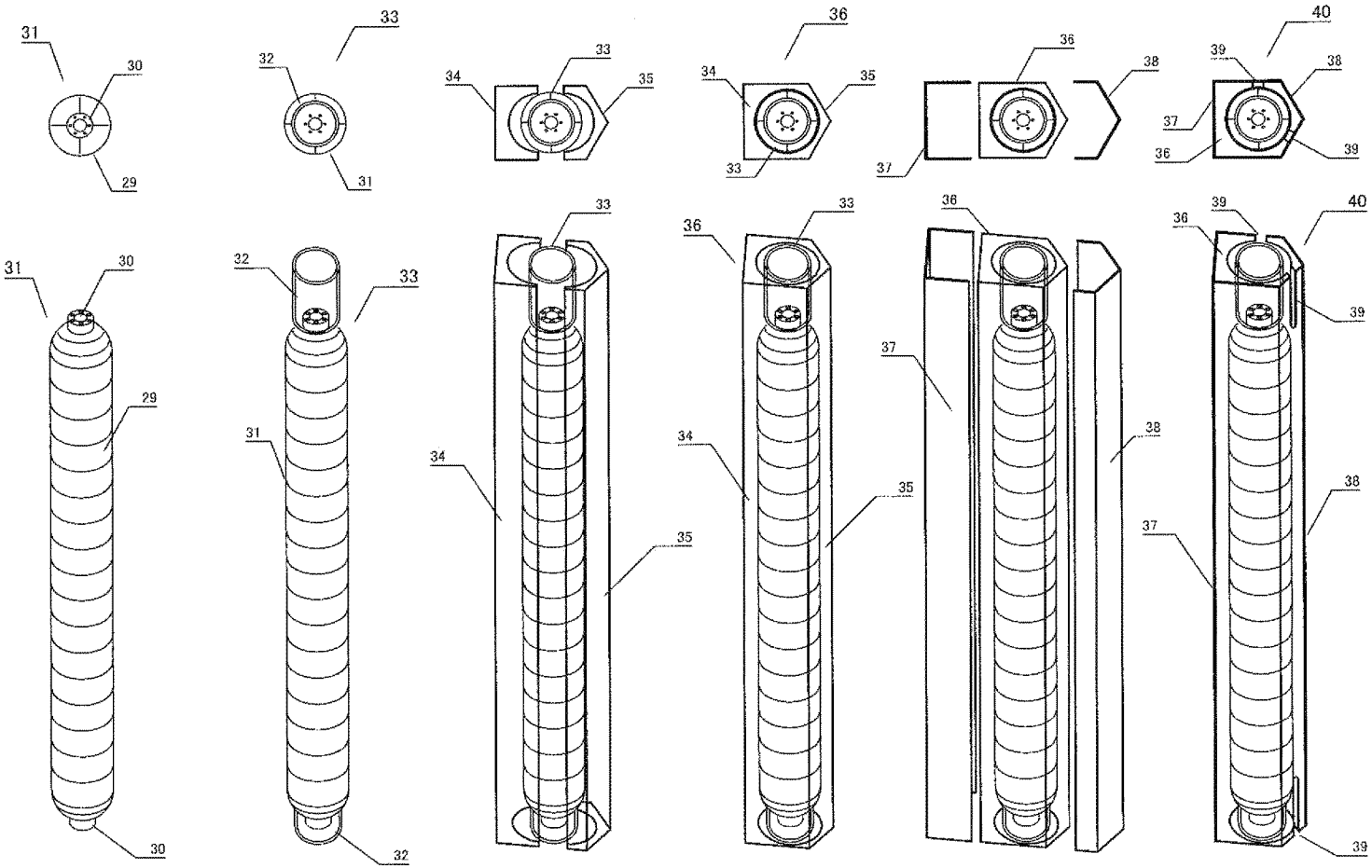
FIG. 4(A), FIG. 4(B), FIG. 4(C), FIG. 4(D), FIG. 4(E) and FIG. 4(F) shows a manufacturing process chart of a Pentagon Cell Tank (40).

FIG. 4(A) shows a concept chart of an Internal Tank (31). Internal Tank (31) is composed of a Reinforced Tank (29) and a Connection Port (30). Reinforced Tank (29) is reinforced by thermosetting carbon prepreg. Connection Port (30) is a connection port to the adjoining honeycomb cell tank, and it is used for the processing work as well. Two Connection Ports (30) are placed at the top and the bottom of the Reinforced Tank (29).

FIG. 4(B) shows a concept chart of an Internal Tank with Height Adapter (33). The Internal Tank with Height Adapter (33) is composed of Internal Tank (31) and Height Adaptor (32). Height Adaptor (32) is made of steel and used as a bottom support adaptor and a hanging fitting for the Internal Tank (31).

It is difficult to maintain the height position of Connection Port (30) constant because Internal Tank (31) slips down by gravity if there is no support. Height Adaptor (32) is used as bottom support of Internal Tank (31). Height Adaptor (32) maintains the height position of Connection Port (30), accurately. Additionally, Height Adaptor (32) is used also for a fitting when Internal Tank (31) is hung down by crane while work process.

FIG. 4(C) shows a processing chart of Pentagon Foam Resin. Pentagon Foam Resin is manufactured by uniting Quadrangle Foam Resin (34) and Hexagon Foam Resin (35) to surround the Internal Tank (31). Quadrangle Foam Resin (34) is in the shape of a foursquare pillar cut in half in the vertical direction. When two Quadrangle Foam Resins (34) are matched together, it becomes a square. Hexagon Foam Resin (35) is in the shape of a hexagon pillar cut in half in the vertical direction. When two Hexagon Foam Resins (35) is matched together, it becomes a hexagon. When Quadrangle Foam Resin (34) and Hexagon Foam Resin (35) are matched together, it becomes a pentagon pillar that has a cylindrical vacant space. Cylinder diameter is made 2 mm to 5 mm bigger than the radius of a Tank Assembly with Height Adapter (33). The length of Quadrangle Foam Resin (34) and Hexagon Foam Resin (35) is manufactured as well as Tank Assembly with Height Adapter (33). Quadrangle Foam Resin (34) and Hexagon Foam Resin (35) are made from foam resin which begins to foam at about 110° C. The heat foam of Quadrangle Foam Resin (34) and Hexagon Foam Resin (35) continues until they are completely cooled.

FIG. 4(D) shows a concept chart of a Pentagon Foam Resin with Internal Tank (36). Pentagon Foam Resin with Internal Tank (36) is composed of Tank Assembly with Height Adapter (33), Quadrangle Foam Resin (34) and Hexagon Foam Resin (35). Tank Assembly with Height Adapter (33) is placed in the pentagon pillar with cylindrical vacant space. It is also possible to insert Tank Assembly with Height Adapter (33) from the upper side in the inside of the pentagon pillar that has cylindrical vacant space. Quadrangle Foam Resin (34) and Hexagon Foam Resin (35) are united with the pressure sensitive adhesive double-coated tape. As for the base material of the double-coated tape, a cotton cloth is preferable.

FIG. 4(E) shows a processing chart of a Pentagon Cell Tank. The Pentagon Cell Tank is manufactured by attaching Quadrangle Prepreg (37) and Hexagon Prepreg (38) to Pentagon Foam Resin with Internal Tank (36). Quadrangle Prepreg (37) is a shell made of carbon fiber or glass fiber thermoplastic prepreg, in the shape of a foursquare pillar cut in half in the vertical direction. Quadrangle Prepreg (37) is attached to Pentagon Foam Resin with Internal Tank (36) for structural reinforcement. Hexagon Prepreg (38) is a shell made of carbon fiber or glass fiber thermoplastic prepreg, whose shape is a cutting into the half of hexagon pillars in the vertical direction. Hexagon Prepreg (38) is attached to Pentagon Foam Resin with Internal Tank (36) for structural reinforcement. The length of Quadrangle Prepreg (37) and Hexagon Prepreg (38) is manufactured as well as Pentagon Foam Resin with Internal Tank (36). The parts manufactured from thermoplastic prepreg soften at about 100° C., and are merged at about 130° C.

FIG. 4(F) shows a concept chart of a Pentagon Cell Tank (40). Pentagon Cell Tank (40) is composed of Pentagon Foam Resin with Internal Tank (36), Quadrangle Prepreg (37) and Hexagon Prepreg (38). Connection Cutting Lack (39) is cut in Pentagon Cell Tank (40). Connection Cutting Lacks (39) are placed at the top and the bottom of Pentagon Cell Tank (40). Honeycomb structure set tank is composed of the array of plurality of Pentagon Cell Tanks (40), which is a basic component of the honeycomb structure set tank. Pentagon Cell Tanks (40) compose the material of the honeycomb structure set tank in the surrounding periphery. Quadrangle Prepreg (37) and Hexagon Prepreg (38) are the honeycomb cell walls. Connection Cutting Lack (39) is a cutting lack for the connection of the internal tanks built into Pentagon Cell Tank (40). Quadrangle Prepreg (37) and Hexagon Prepreg (38) are attached to Pentagon Foam Resin with Internal Tank (36) with pressure sensitive adhesive double-coated tape. As for the base material of the double-coated tape, a cotton cloth is preferable.

FIG. 5(A), FIG. 5(B), FIG. 5(C), FIG. 5(D), FIG. 5(E) and FIG. 5(F) shows a manufacturing process chart of a Hexagon Cell Tank.

Figures 5A, 5B, 5C, 5D, 5E, 5F:
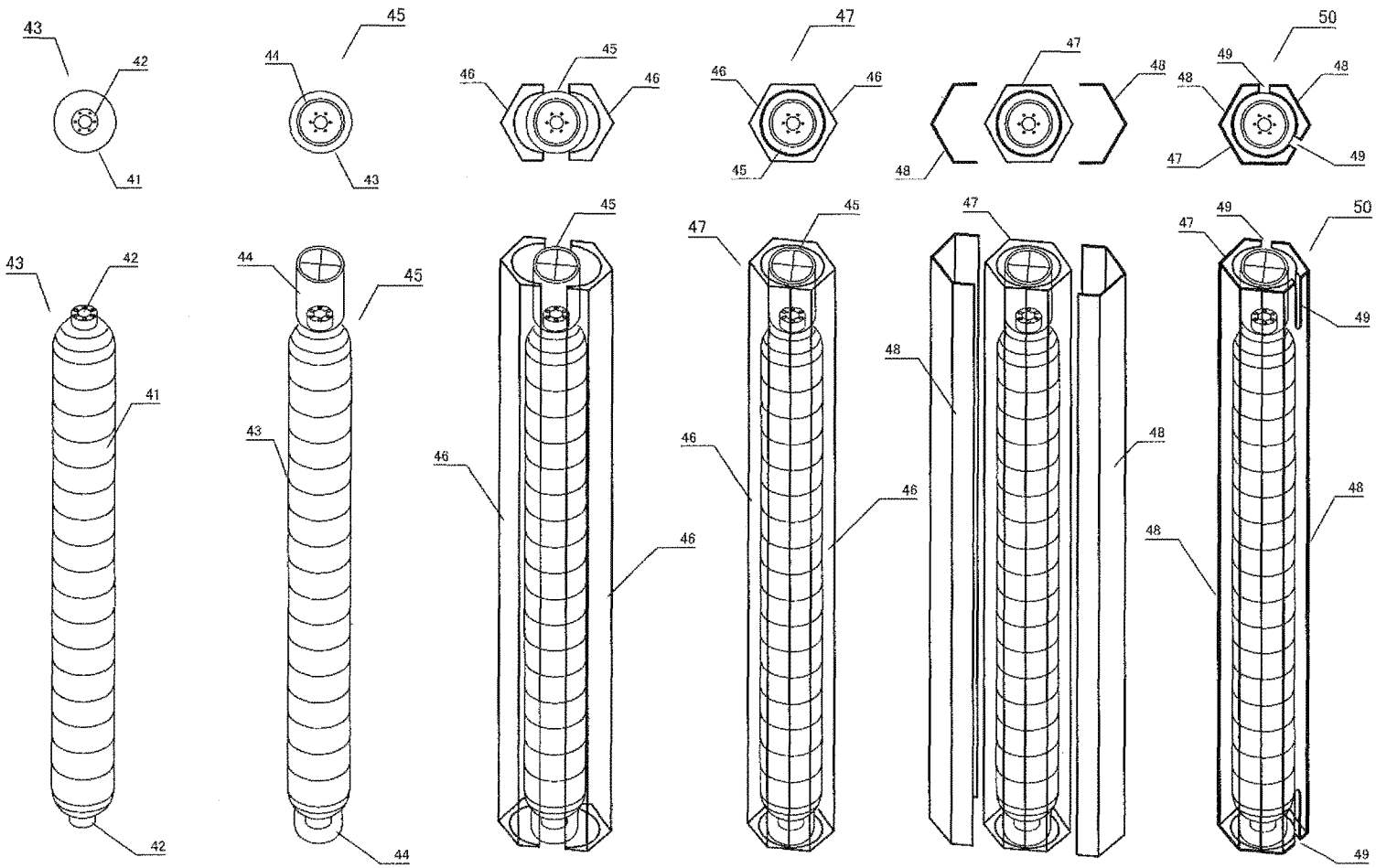
FIG. 5(A), FIG. 5(B), FIG. 5(C), FIG. 5(D), FIG. 5(E) and FIG. 5(F) shows a manufacturing process chart of a Hexagon Cell Tank.

FIG. 5(A) shows a concept chart of an Internal Tank (43). Internal Tank (43) is composed of Reinforced Tank (41) and Connection Port (42). Reinforced Tank (41) is reinforced by thermosetting carbon prepreg. Connection Port (42) is a connection port to the adjoining honeycomb cell tank, and it is used for processing work as well. Two Connection Ports (42) are placed at the top and the bottom of each Reinforced Tank (41).

FIG. 5(B) shows a concept chart of an Internal Tank with Height Adapter (45). Internal Tank with Height Adapter (45) is composed of internal Tank (43) and Height Adaptor (44). Height Adaptor (44) is made of steel and used as a bottom support adaptor and a hanging fitting of Internal Tank (43).

It is difficult to maintain the height position of Connection Ports (42) constant because Internal Tank (43) slips down by gravity if there is no support. Height Adaptor (44) is used as the bottom support of Internal Tank (43). Height Adaptor (44) maintains the height position of Connection Port (43), accurately. Additionally, Height Adaptor (44) is used also for a fitting when Internal Tank (31) is hung down by crane while work process.

FIG. 5(C) shows a processing chart of Hexagon Foam Resin. Hexagon Foam Resin is manufactured by uniting of two Hexagon Foam Resins (46). Hexagon Foam Resin (46) is in the shape of a hexagon pillar cut in half in the vertical direction. When two Hexagon Foam Resins (46) are matched together, they become a hexagon pillar that has cylindrical vacant space. The cylinder diameter is made 2 mm to 5 mm bigger than radiuses of Tank Assembly with Height Adapter (45). Hexagon Foam Resin (46) is manufactured as well as Tank. Assembly with Height Adapter (45). Hexagon Foam Resin (46) is made from foam resin which begins to foam at about 110° C. The heat foam of Hexagon Foam Resin (46) continues until it is completely cooled.

FIG. 5(D) shows a concept chart of a Hexagon Foam Resin with Internal Tank (47). Hexagon Foam Resin with Internal Tank (47) is composed of Tank Assembly with Height Adapter (45), and two Hexagon Foam Resins (46). Tank Assembly with Height Adapter (45) is placed in the hexagon pillar with cylindrical vacant space. It is also possible to insert Tank Assembly with Height Adapter (45) from the upper side in the inside of the hexagon pillar that has the cylindrical vacant space. Two Hexagon Foam Resins (46) are united with the pressure sensitive adhesive double-coated tape. As for the base material of the double-coated tape, a cotton cloth is preferable.

FIG. 5(E) shows a processing chart of a Hexagon Cell Tank. Hexagon Cell Tank is manufactured by attaching two Hexagon Prepregs (48) to Hexagon Foam Resin with Internal Tank (47). Hexagon Prepreg (48) is a shell made of carbon fiber or glass fiber thermoplastic prepreg, in the shape of a hexagon pillar cut in half in the vertical direction. Hexagon Prepreg (48) is attached to Hexagon Foam Resin with Internal Tank (47) for structural reinforcement. The length of Hexagon Prepreg (48) is manufactured as well as Hexagon Foam Resin with Internal Tank (47). The parts manufactured from thermoplastic prepreg soften at about 100° C., and are merged at about 130° C.

FIG. 5(F) shows a concept chart of a Hexagon Cell Tank (50). Hexagon Cell Tank (50) is composed of Hexagon Foam Resin with Internal Tank (47) and two Hexagon Prepregs (48). Connection Cutting Lack (49) is cut in Hexagon Cell Tank (50). Connection Cutting Lacks (49) are placed at the top and the bottom of Hexagon Cell Tank (50). The honeycomb structure set tank is composed of an array of a plurality of Hexagon Cell Tanks (50), which is a basic component of the honeycomb structure set tank. Hexagon Cell Tank (50) embodies the material of the honeycomb structure set tank in the central part. Two Hexagon Prepregs (48) are the honeycomb cell walls. Connection Cutting Lack (49) is a cutting lack for the connection of internal tanks built into Hexagon Cell Tank (50). Two Hexagon Prepregs (38) are attached to Hexagon Foam Resin with Internal Tank (47) with pressure sensitive adhesive double-coated tape. As for the base material of the double-coated tape, a cotton cloth is preferable.

Figure 6B:
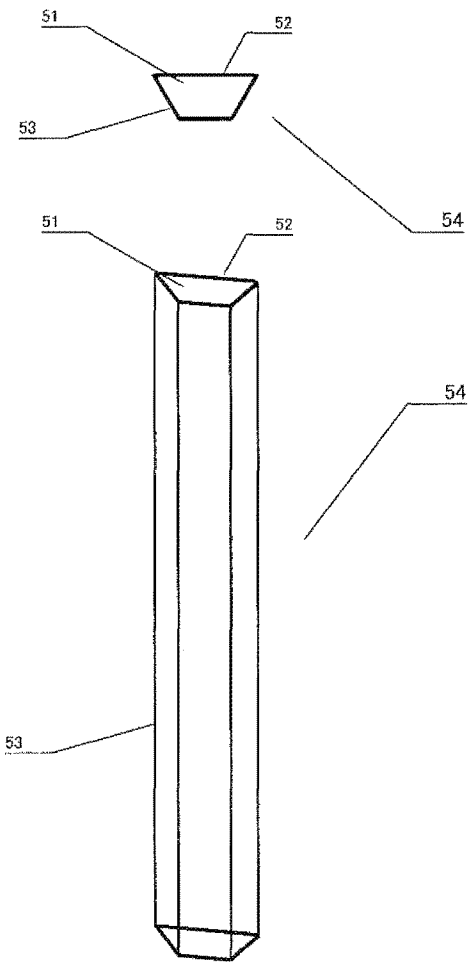
FIG. 6(B) shows a concept chart of a Trapezoid Filler (54) using the references of Trapezoid Foam Resin (51), Flat Board Prepreg (52) and Trapezoid Prepreg (53).
Figure 6A:
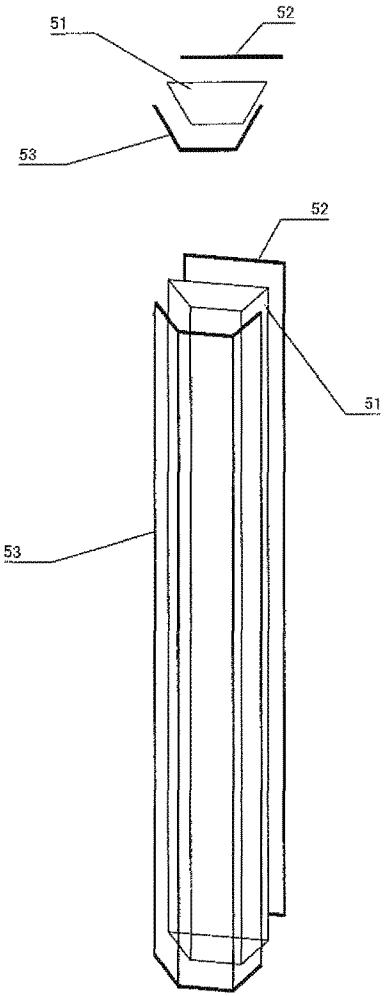
FIG. 6(A) shows a processing chart of a Trapezoid Filler using the references of Trapezoid Foam Resin (51), Flat Board Prepreg (52) and Trapezoid Prepreg (53).

FIG. 6(A) shows a processing chart of a Trapezoid Filler. Trapezoid Filler is manufactured by attaching Flat Board Prepreg (52) and Trapezoid Prepreg (53) to Trapezoid Foam Resin (51). Trapezoid Foam Resin (51) is made from foam resin which begins to foam at about 110° C. and Trapezoid Foam Resin (51) continues foaming until being completely cooled. Flat Board Prepreg (52) and Trapezoid Prepreg (53) are made from carbon or glass fiber thermoplastic prepreg. The shape of Flat Board Prepreg (52) is equal to a trapezoid bottom of Trapezoid Foam Resin (51). Trapezoid Prepreg (53) is a shell made of carbon fiber or glass fiber thermoplastic prepreg whose shape is equal to a trapezoid upper shape of Trapezoid Foam Resin (51). Flat Board Prepreg (52) and Trapezoid Prepreg (53) are attached to Trapezoid Foam Resin (51) with the pressure sensitive adhesive double-coated tape. As for the base material of the double-coated tape, a cotton cloth is preferable.

FIG. 6(B) shows a concept chart of a Trapezoid Filler (54). Trapezoid Filler (54) is composed of Trapezoid Foam Resin (51), Flat Board Prepreg (52) and Trapezoid Prepreg (53). Trapezoid Filler (54) is a part to correct irregularities or voids, which are created at the surrounding portions of the honeycomb structure. The lengths of Trapezoid Foam Resin (51), Flat Board Prepreg (52) and Trapezoid Prepreg (53) are equal to the length of the honeycomb structure to be manufactured.

Figure 7:
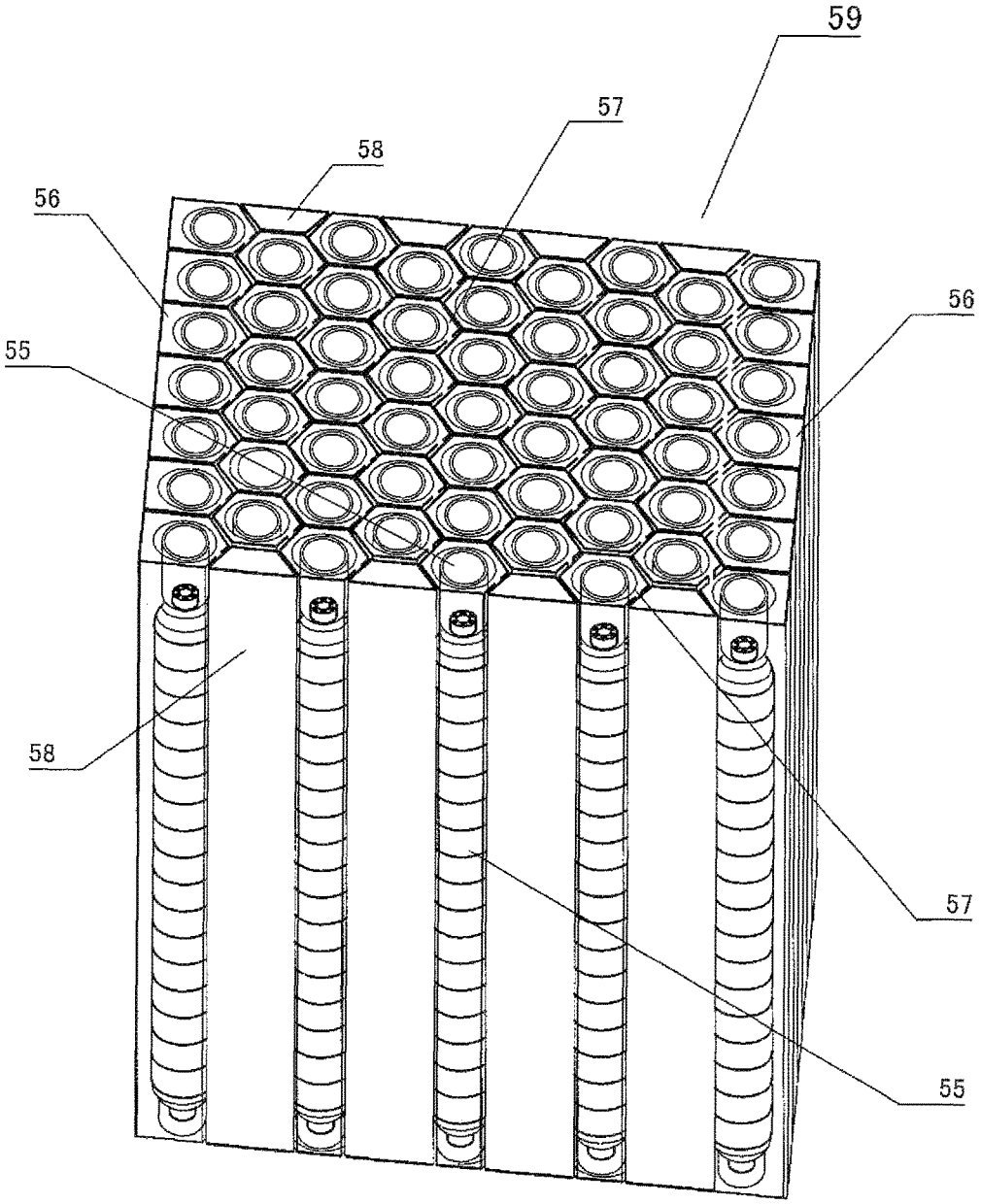
FIG. 7 shows an image chart of a Honeycomb Set Tank (59) using the references of (55) Internal Tank, (56) Pentagon Cell Tank, (57) Hexagon Cell Tank and (58) Trapezoid Filler.

FIG. 7 shows an image chart of a Honeycomb Set Tank (59). The external shape of Honeycomb Set Tank (59) is a hexahedron. Honeycomb Set Tank (59) is composed of pluralities of Pentagon Cell Tanks (56), Hexagon Cell Tanks (57) and Trapezoid Fillers (58). Internal Tanks (55) are stored in Pentagon Cell Tanks (56) and Hexagon Cell Tanks (57). Pentagon Cell Tanks (56) are placed surrounding the Honeycomb Set Tanks (59). Hexagon Cell Tanks (57) are positioned centrally relative to the Honeycomb Set Tanks (59). Trapezoid Filler Assemblies (58) are used to correct the irregularities and voids, which is formed along the surrounding portions of the honeycomb structure.

Internal Tank (55) is heated and pressurized by the compressed air at high temperature from the inside. The entire Honeycomb Set Tank (59) is heated from outside in a large-scale heat oven. The heat foam resin included in Pentagon Cell Tanks (56), Hexagon Cell Tanks (57) and Trapezoid Fillers (58) foams and expands when heated to a high temperature.

When the outside wall of Honeycomb Set Tank (59) is restrained with an external frame, the pluralities of Pentagon Cell Tanks (56), Hexagon Cell Tanks (57) and Trapezoid Fillers (58) are mutually jostled. The thermoplastic carbon fiber or glass fiber prepreg shells are attached on the surfaces of Pentagon Cell Tanks (56), Hexagon Cell Tanks (57) and Trapezoid Fillers (58). The thermoplastic carbon fiber or glass fiber prepreg shells are divided into two parts. So, the thermoplastic carbon fiber or glass fiber prepreg shells, which are structural material of the honeycomb structure, can freely expand. The thermoplastic carbon fiber or glass fiber prepreg shell melts when Honeycomb Set Tank (59) is heated to about 130° C. Then, pluralities of Pentagon Cell Tank (56), Hexagon Cell Tank (57) and Trapezoid Filler (58) are merged mutually.

During heating, Internal Tanks (55) that are stored in Pentagon Cell Tanks (56) and Hexagon Cell Tanks (57) are strongly pressurized by the heat foam resin. The surface of Internal Tank (55) is reinforced by accumulated carbon fiber thermosetting prepregs. When the accumulated carbon fiber thermosetting prepregs are heated to about 130° C., carbon fiber prepregs are strongly pressurized with the heat foam resin and internal pressure of Internal Tank (55). Then, the accumulated carbon fiber thermosetting prepregs of Internal Tank (55) are merged mutually.

Figure 8A:
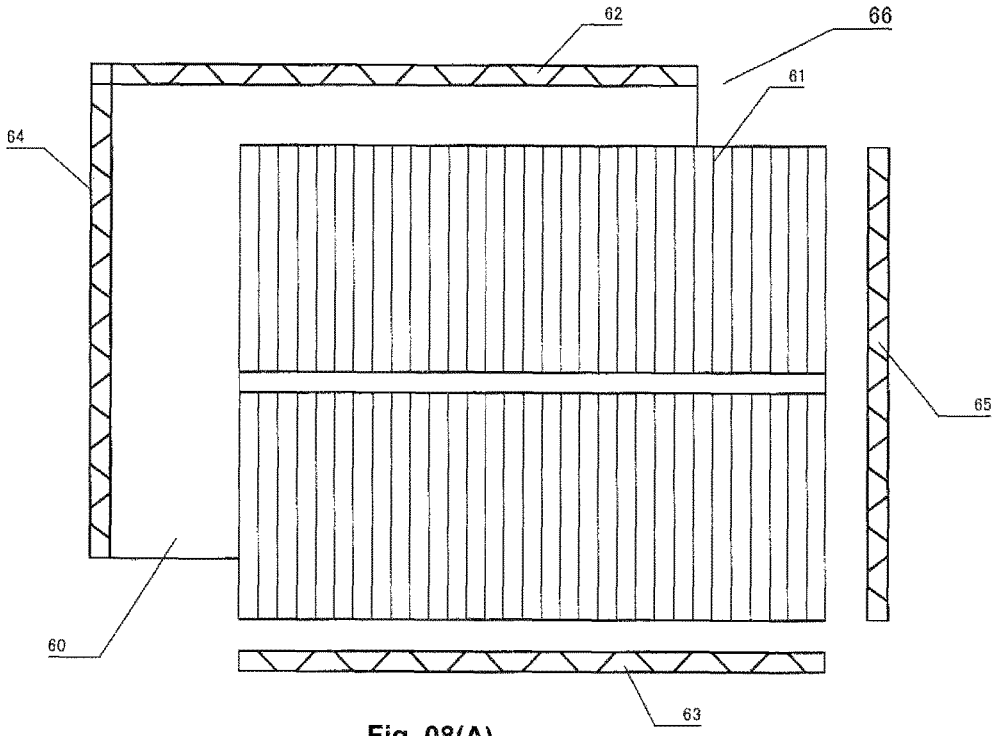
FIG. 8(A) shows a plan chart of a Container Wall Assembly (66).
Figure 8B:
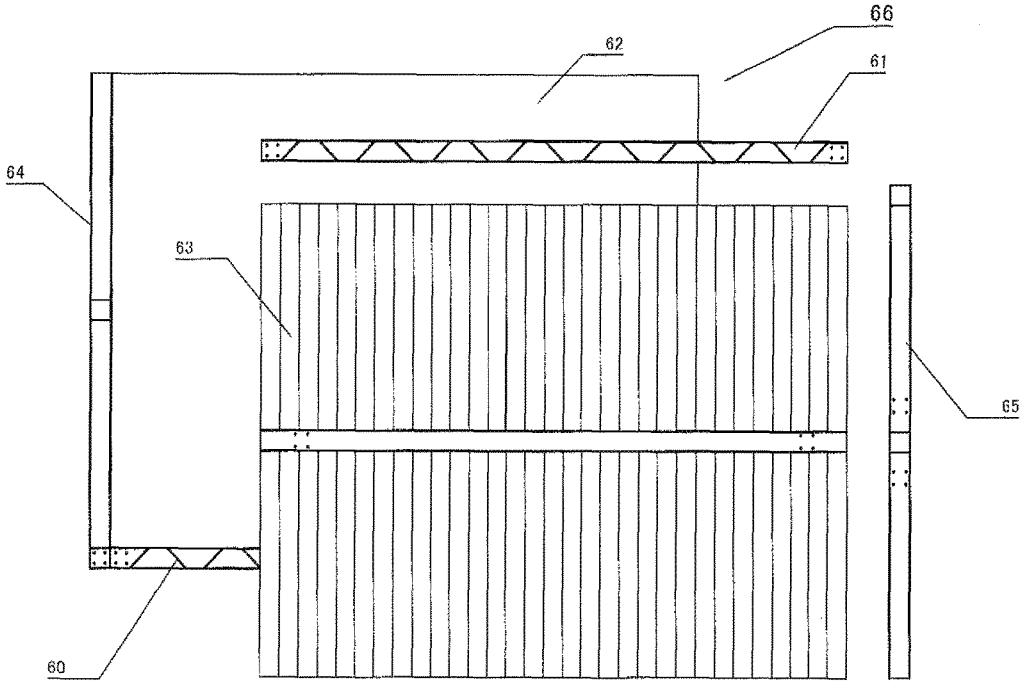
FIG. 8(B) shows a front chart of a Container Wall Assembly (66).

FIG. 8(A) and FIG. 8(B) shows a concept chart of a Container Wall Assembly (66). The manufacturing process for a Honeycomb Set Tank will be explained with an example of a ten-foot container.

FIG. 8(A) shows a plan chart of a Container Wall Assembly (66). FIG. 8(B) shows a front chart of a Container Wall Assembly (66). Container Wall Assembly (66) is composed of Bottom Wall (60), Top Wall (61), Rear Wall (62), Front Wall (63), Left Side Wall (64) and Right Side Wall (65). Bottom Wall (60), Top Wall (61), Rear Wall (62), Front Wall (63), Left Side Wall (64) and Right Side Wall (65) are manufactured from steel and they are boards with a flat inside wall, and the outside wall is a corrugated plate.

Figure 9A:
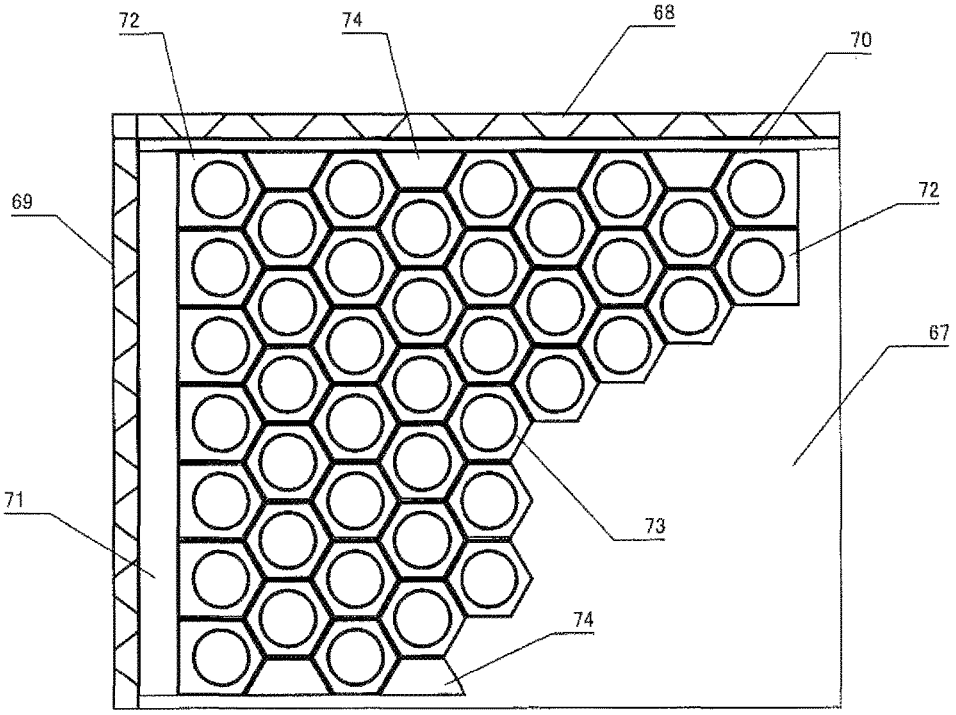
FIG. 9(A) shows a processing plan chart of a Container Honeycomb Cell.
Figure 9B:
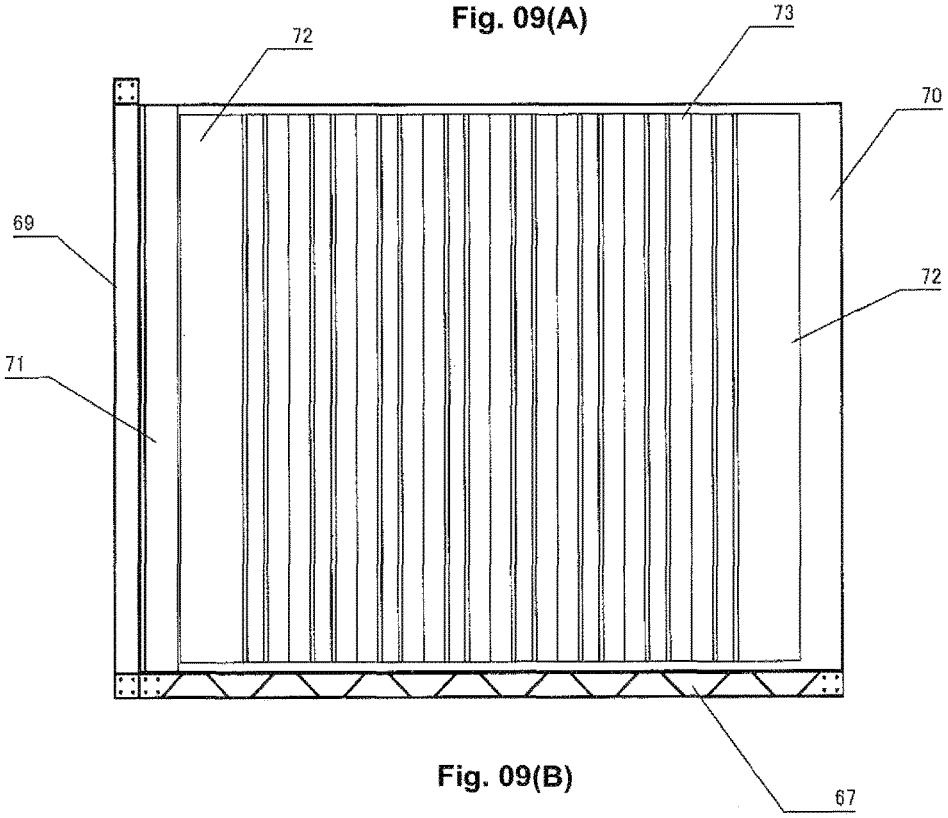
FIG. 9(B) shows a processing front chart of a Container Honeycomb Cell.

FIG. 9(A) and FIG. 9(B) show processing charts of a Container Honeycomb Cell. FIG. 9(A) shows a plan chart and FIG. 9(B) shows a front chart. The Container Honeycomb Cell is composed of Bottom Wall (67), Rear Wall (68), Left Side Wall (69), Rear Cushion Wall (70), Left Side Cushion Wall (71), Pentagon Honeycomb Cell (72), Hexagon Honeycomb Cell (73) and Trapezoid Filler (74). Bottom Wall (67), Rear Wall (68) and Left Side Wall (69) are manufactured from steel and they are boards with a flat inside wall, and the outside wall is a corrugated plate. Rear Cushion Wall (70) and Left Side Cushion Wall (71) are manufactured from heat foam resin and they protect the honeycomb set tank from external shock loading. Pentagon Honeycomb Cell (72) is composed of a pentagon heat form resin and a pentagon shell made of carbon fiber or glass fiber thermoplastic prepreg. Hexagon Honeycomb Cell (73) is composed of a hexagon heat form resin and a hexagon shell made of carbon fiber or glass fiber thermoplastic prepreg. Trapezoid Filler (74) is composed of a trapezoid hexagon heat form resin and a trapezoid shell made of carbon fiber or glass fiber thermoplastic prepreg.

The Manufacturing process for the Container Honeycomb Cell is composed of three steps:

(1) Three container walls, Bottom Wall (67), Rear Wall (68), Left Side Wall (69), are assembled into a triangular configuration.

(2) Rear Cushion Wall (70) and Left Side Cushion Wall (71) are squarely assembled on Bottom Wall (67)

(3) A plurality of Pentagon Honeycomb Cells (72), Hexagon Honeycomb Cells (73) and Trapezoid Fillers (74) are set up for shaping the honeycomb structure. A plurality of Pentagon Honeycomb Cells (72), Hexagon Honeycomb Cells (73) and Trapezoid Fillers (74) are assembled together with the outer shell.

Pentagon Honeycomb Cells (72) are placed surrounding the outer portions of the Container Honeycomb Cell. Hexagon Honeycomb Cells (73) are placed at the central part. Trapezoid Fillers (74) are filled in to correct the irregularities and voids which result along the outer surrounding periphery of the honeycomb structure. The outer shells of Pentagon Honeycomb Cells (72), Hexagon Honeycomb Cells (73) and Trapezoid Fillers (74) are manufactured from thermoplastic carbon fiber or glass fiber prepreg. Thermoplastic carbon fiber or glass fiber prepreg is not cohesive at the room temperature, so the assembly operation of the honeycomb structure is not difficult.

Figure 10A:
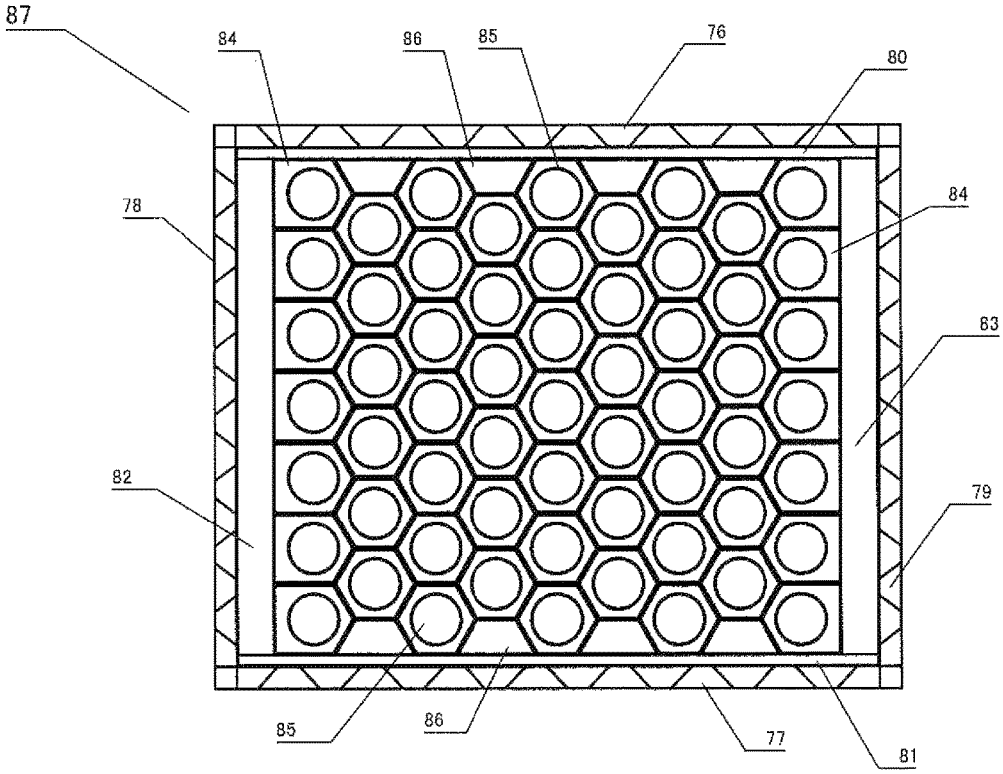
FIG. 10(A) shows a concept plan chart of a Container Honeycomb Cell (87).
Figure 10B:
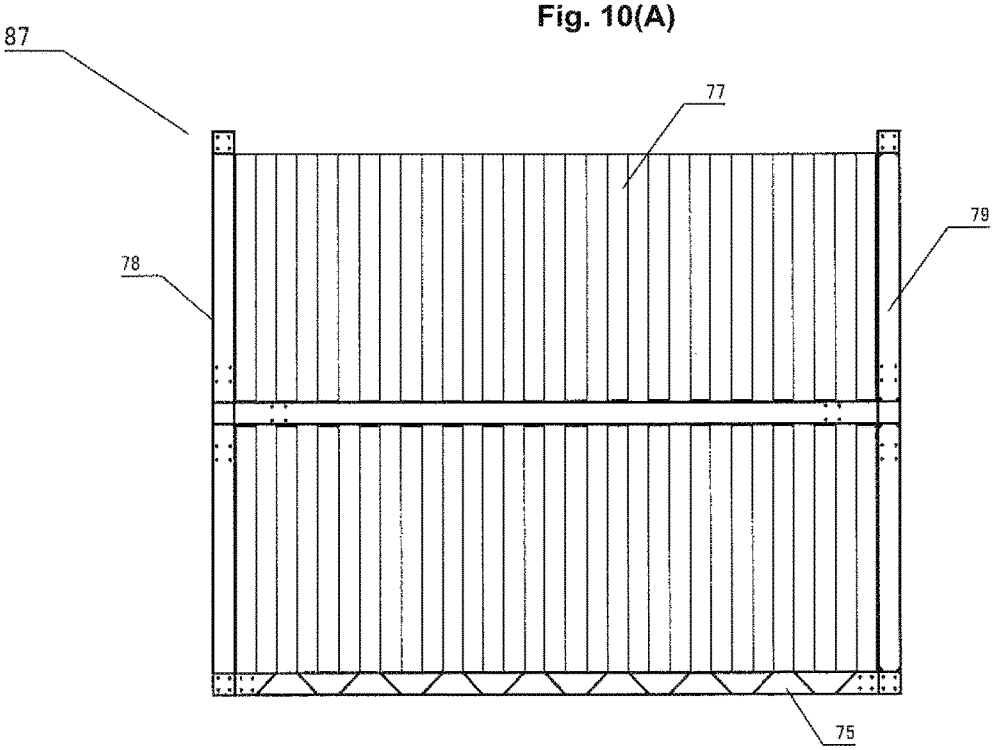
FIG. 10(B) shows a concept front chart of a Container Honeycomb Cell (87).

FIG. 10(A) and FIG. 10(B) show a concept chart of a Container Honeycomb Cell (87). FIG. 10(A) shows a plan concept chart of Container Honeycomb Cell (87). FIG. 10(B) shows a front concept chart.

Container Honeycomb Cells (87) are composed of Bottom Wall (75), Rear Wall (76), Front Wall (77), Left Side Wall (78), Right Side Wall (79), Rear Cushion Wall (80), Front Cushion Wall (81), Left Side Cushion Wall (82), Right Side Cushion Wall (83), Pentagon Honeycomb Cells (84), Hexagon Honeycomb Cells (85) and Trapezoid Fillers (86). Bottom Wall (75), Rear Wall (76), Front Wall (77), Left Side Wall (78) and Right Side Wall (79) are manufactured from steel. Rear Cushion Wall (80), Front Cushion Wall (81), Left Side Cushion Wall (82) and Right Side Cushion Wall (83) are manufactured from heat foam resin. Pentagon Honeycomb Cells (84), Hexagon Honeycomb Cells (85) and Trapezoid Fillers (86) are manufactured from heat foam resin and carbon fiber or glass fiber thermoplastic prepreg. Pentagon Honeycomb Cells (84), Hexagon Honeycomb Cells (85) and Trapezoid Fillers (86) are manufactured from heat foam resin and carbon fiber or glass fiber thermoplastic prepreg. Each Pentagon Honeycomb Cell (84) and Hexagon Honeycomb Cell (85) has a large cavity, wherein an internal tank is stored in each cavity.

Figure 11A:
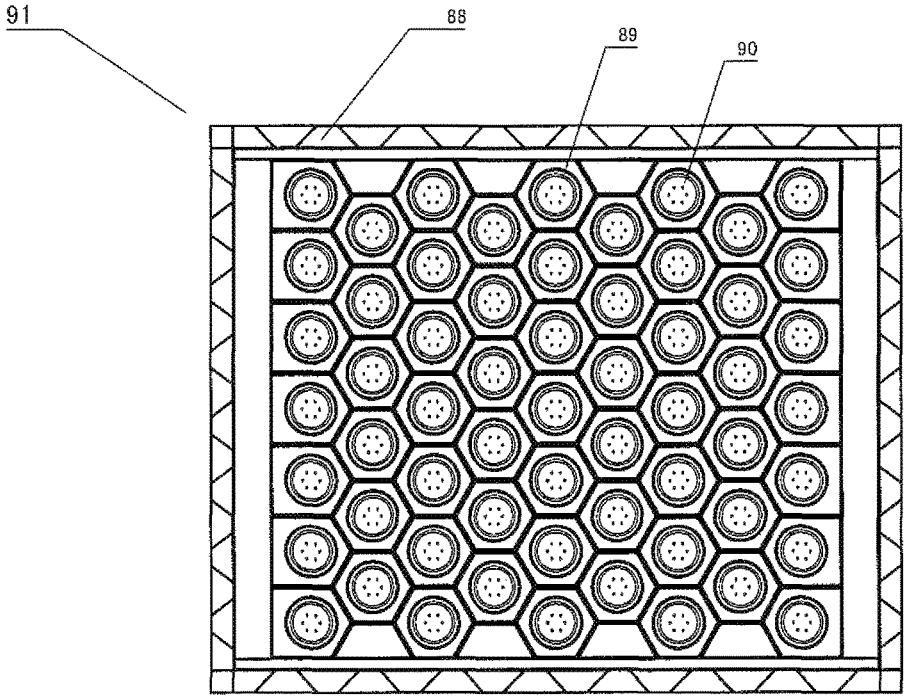
FIG. 11(A) shows a processing plan chart of a Container Honeycomb Cell Tank with Height Adapter (91).
Figure 11B:
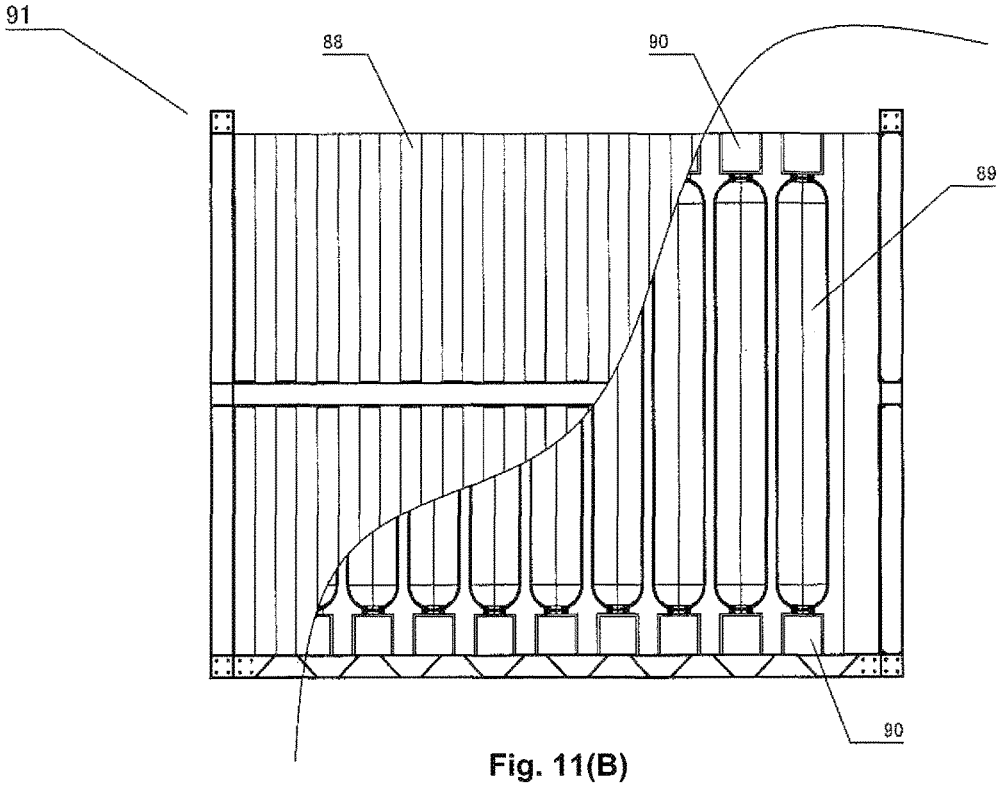
FIG. 11(B) shows a processing front chart.

FIG. 11(A) and FIG. 11(B) show a processing chart of a Container Honeycomb Cell Tank with Height Adapter (91). FIG. 11(A) shows a plan chart, and FIG. 11(B) shows a front chart.

Container Honeycomb Cell Tank with Height Adapter (91) is composed of Container Honeycomb Cell (88), internal Tank (89) and Height Adapter (90). Container Honeycomb Cell (88) is the same as Container Honeycomb Cell (87) in FIG. 10. Internal Tank (89) is the same as Internal Tank (31) in FIG. 4 and Internal Tank (43) in FIG. 5. Height Adapter (90) is the same as Height Adapter (32) in FIG. 4 and Height Adapter (44) in FIG. 5.

Container Honeycomb Cell Tank with Height Adapter (91) is assembled by inserting Internal Tank (89), to which Height Adapter (90) is attached, into the cavity of Container Honeycomb Cell (88). Internal Tank (89) is inserted into Container Honeycomb Cell (88) from above by crane. The assembling operation of a Container Honeycomb Cell Tank with Height Adapter (91) is not difficult, because the cavity diameter of each Container Honeycomb Cell (88) is larger than the diameter of Internal Tank (89).

Figure 12A:
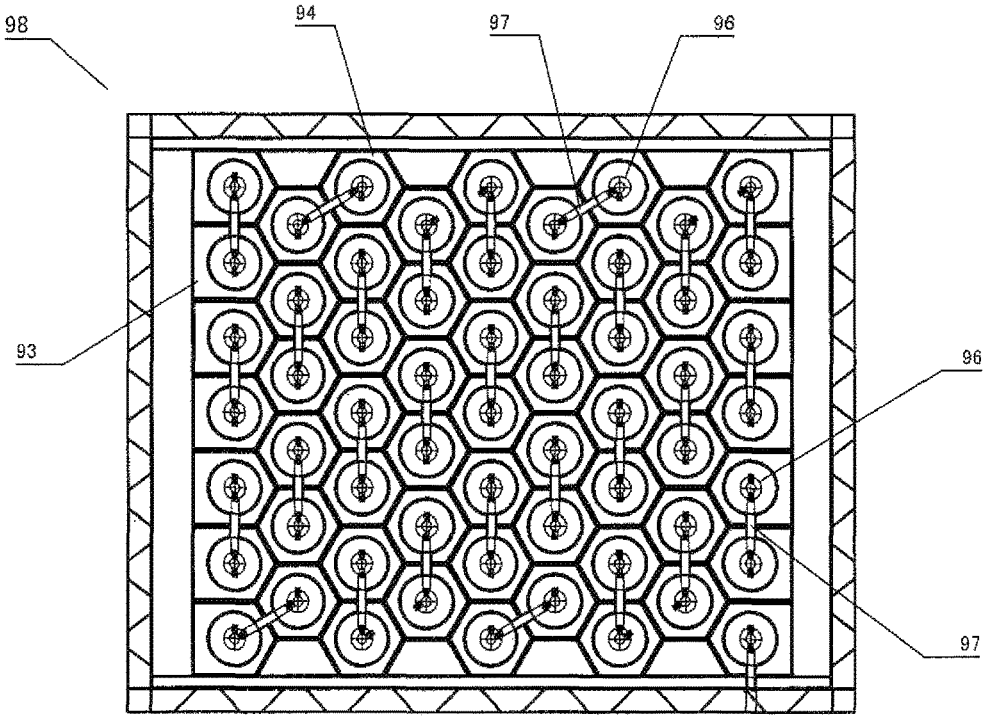
FIG. 12(A) shows a plan chart of a Container Honeycomb Cell Tank Top Piping.
Figure 12B:
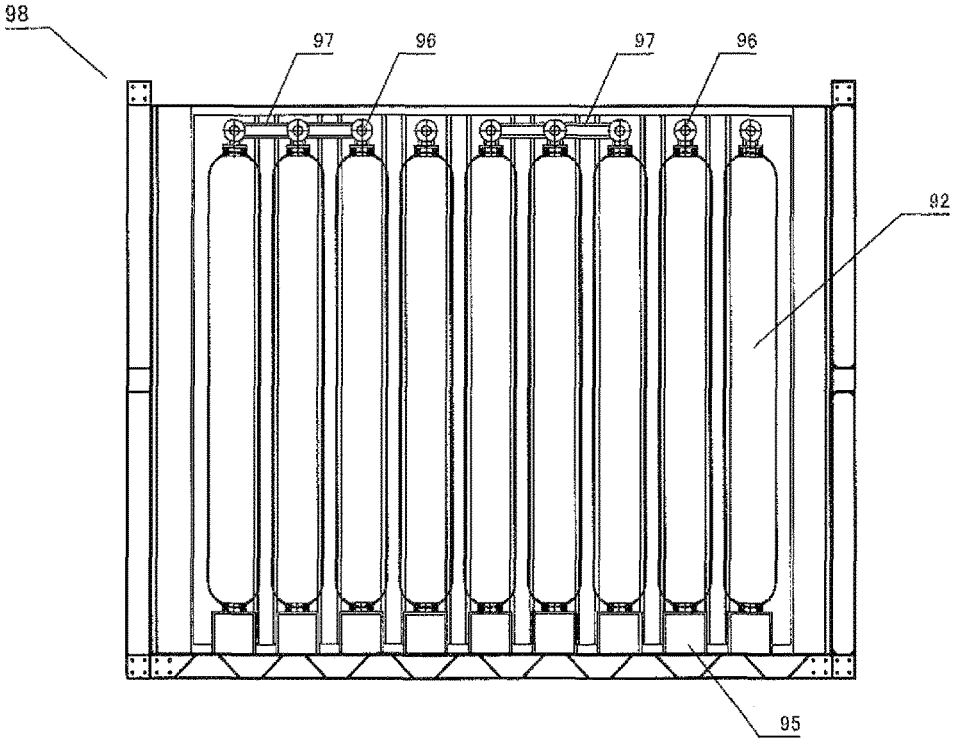
FIG. 12(B) shows a front chart of a Container Honeycomb Cell Tank Top Piping.

FIG. 12(A) and FIG. 12(B) show a processing chart of a Container Honeycomb Cell Tank Top Piping (98). FIG. 12(A) shows a plan chart. FIG. 12(B) shows a front chart.

Container Honeycomb Cell Tank Top Piping (98) is composed of Internal Tanks (92), Pentagon Honeycomb Cells (93), Hexagon Honeycomb Cells (94), Height Adapters (95), Shut Off Valves (96) and Top Pipings (97). Pentagon Honeycomb Cells (93) are the same as Pentagon Cell Tanks (40). Hexagon Honeycomb Cells (94) is the same as Hexagon Cell Tank (50). Internal Tank (92) and Height Adapter (95) is the same as Internal Tank (31), Height Adapter (32) in FIG. 4 and Internal Tank (43), Height Adapter (44) in FIG. 5.

Container Honeycomb Cell Tank Top Piping (98) is assembled by attaching Shut Off Valve (96) and connecting Top Piping (97) to Internal Tank (92). Height Adapter (95) at the top of Internal Tank (92) is removed before attaching Shut Off Valve (96) and Top Piping (97).

It is easy to connect Top Piping (97) to Internal Tank (92), because Top Piping (97) only ties two Internal Tanks (92). Internal Tank (92) can be rotated freely in the cylindrical cavity of Pentagon Honeycomb Cell (93) and Hexagon Honeycomb Cell (94). Additionally, Height Adapter (95) at the bottom uniformly adjusts the height position of the connection ports. Shut Off Valve (96) is attached to Internal Tank (92). Therefore, Top Piping (97) actually connects two Shut Off Valves (96). After the Top Piping is finished, the vacant space above Internal Tank (92) is filled with the granulated powder foam resin, and Top Wall of container is installed. The Top Wall of the container is not shown in FIG. 12.

All Internal Tanks (92) of Container Honeycomb Cell Tank are connected in series. The piping at the bottom is processed with the Container Honeycomb Cell Tank turned 180 degrees and the connections in reverse.

Figure 13A:
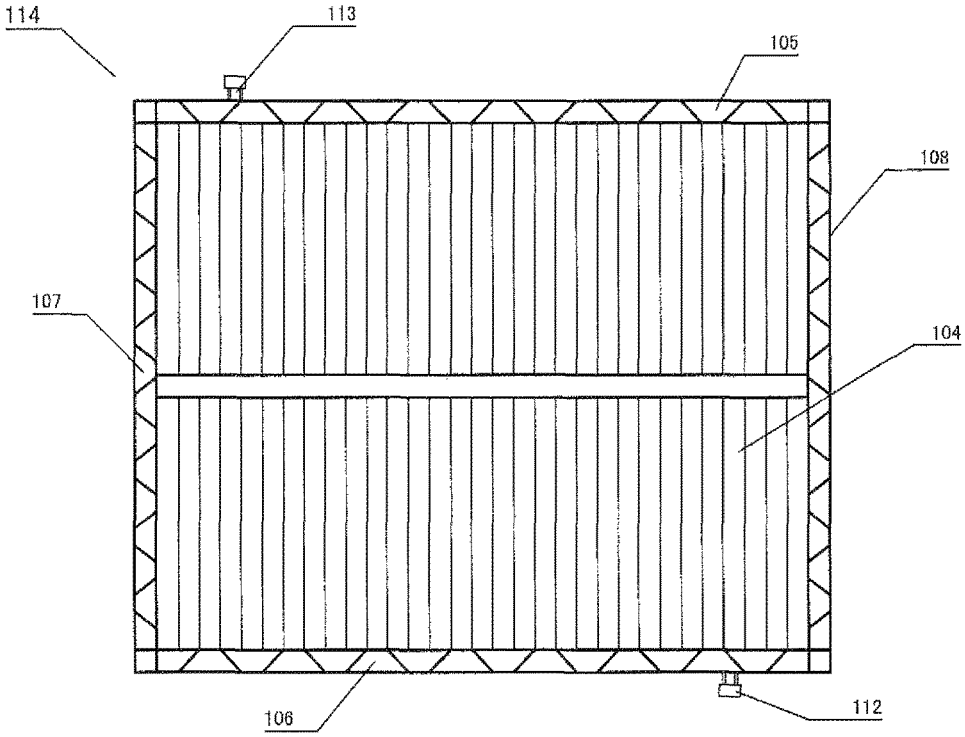
FIG. 13(A) show a plan chart of a Honeycomb Container Tank with Piping.
Figure 13B:
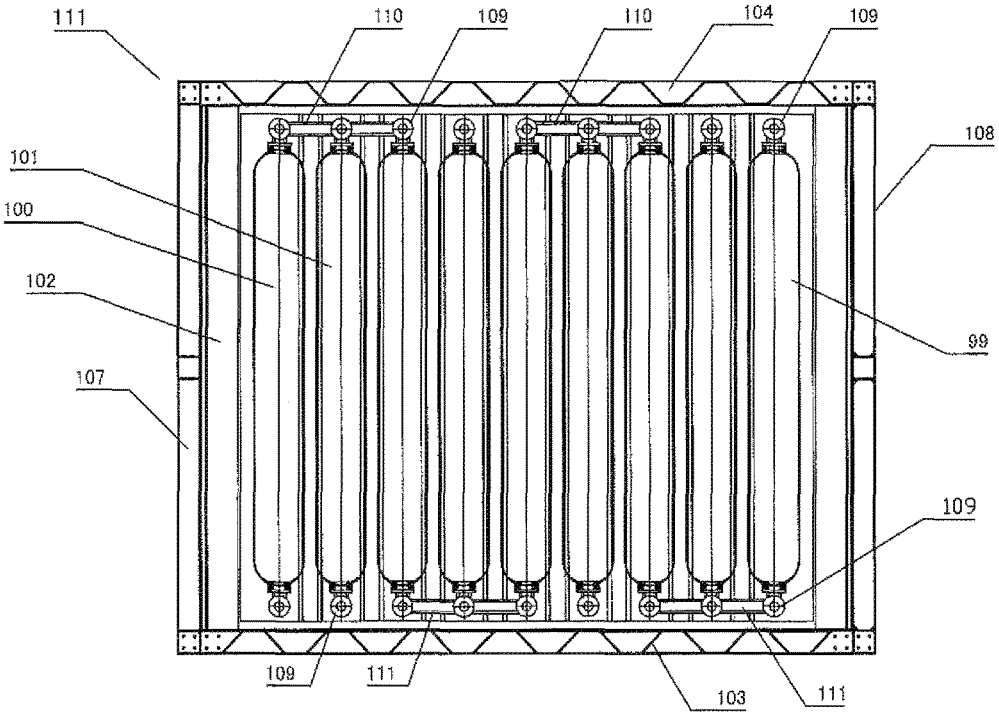
FIG. 13(B) show a front chart of a Honeycomb Container Tank with Piping.

FIG. 13(A) show a plan chart of a Honeycomb Container Tank with Piping (114). FIG. 13(B) show a front chart of a Honeycomb Container Tank with Piping (114).

FIG. 13(A) and FIG. 13(B) show a concept chart of a Honeycomb Container Tank with Piping (114), Honeycomb Container Tank With Piping (114) is composed of Internal Tanks (99), Pentagon Honeycomb Cells (100), Hexagon Honeycomb Cells (101), Cushion Wall (102), Bottom Wall (103), Top Wall (104), Rear Wall (105), Front Wall (106), Left Side Wall (107), Right Side Wall (108), Shut Off Valves (109), Top Piping (110), Bottom Piping (111), Entrance Connection (112) and Exit Connection (113).

Internal Tanks (99) are the same as Internal Tanks (92) in FIG. 12. Pentagon Honeycomb Cells (100) are the same as Pentagon Cell Tanks (84) in FIG. 10. Hexagon Honeycomb Cells (101) are the same as Hexagon Cell Tanks (85) in FIG. 10. Cushion Wall (102) is made of heat foam resin and becomes the cushioning material of the honeycomb set tank. Bottom Wall (103), Top Wall (104), Rear Wall (105), Front Wall (106), Left Side Wall (107), Right Side Wall (108) are the same as Bottom Wall (60), Top Wall (61), Rear Wall (62), Front Wall (63), Left Side Wall (64), Right Side Wall (65) in FIG. 8. Shut Off Valve (109) and Top Piping (110) is the same as Shut Off Valve (96) and Top Piping (97) in FIG. 12.

Bottom Piping (111) is the piping at the bottom of Internal Tanks (99). The piping of the bottom is processed with the honeycomb container tank turned 180 degrees and in reverse. All Internal Tanks (99) are connected in series. It is a little difficult to attach Shut Off Valve (109) and to connect Bottom Piping (111) to Internal Tank (99). Internal Tank (99) cannot be rotated freely in the cylindrical cavity of Pentagon Honeycomb Cell (100) and Hexagon Honeycomb Cell (101), because the top of Internal Tank (99) is already fixed by Top Piping (110). It is necessary to note it is because the piping of Bottom Piping (111) makes a mistake easily in the connection order. The leakage inspection of piping is necessary. After the piping work has finished, the vacant space above Internal Tank (99) is filled with the granulated powder foam resin, and the container wall is installed.

All Internal Tanks (99) in Honeycomb Container Tank with Piping (114) are connected into one line as shown in FIG. 1. Entrance Connection (112) and Exit Connection (113) are the connection ports to the outside.

Figure 14A:
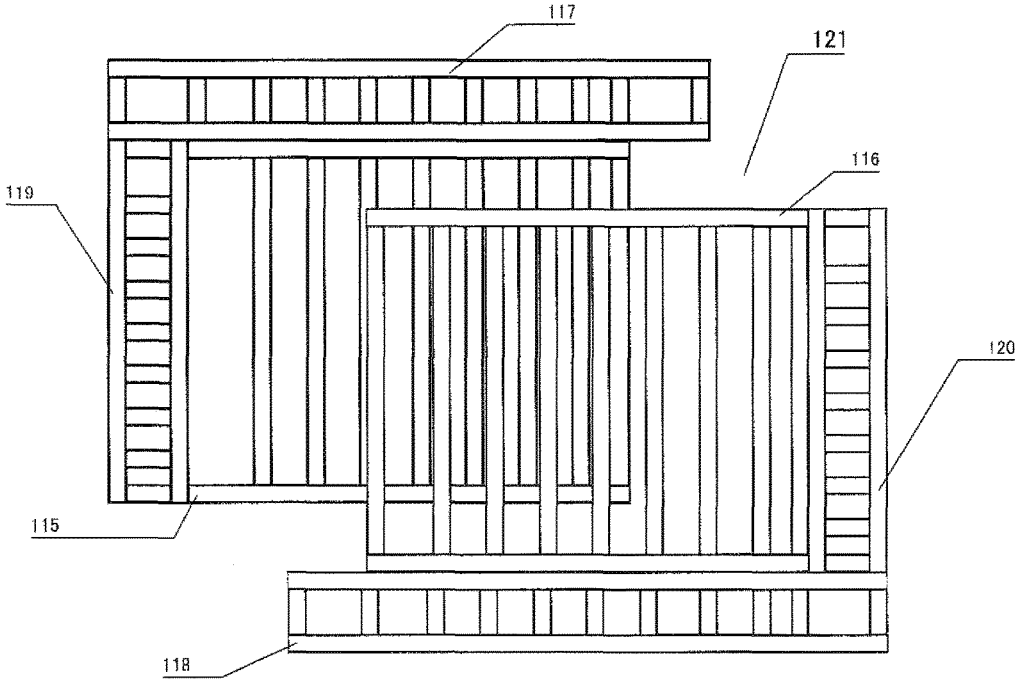
FIG. 14(A) shows a plan chart of a Reinforcement Frame Device (121).
Figure 14B:
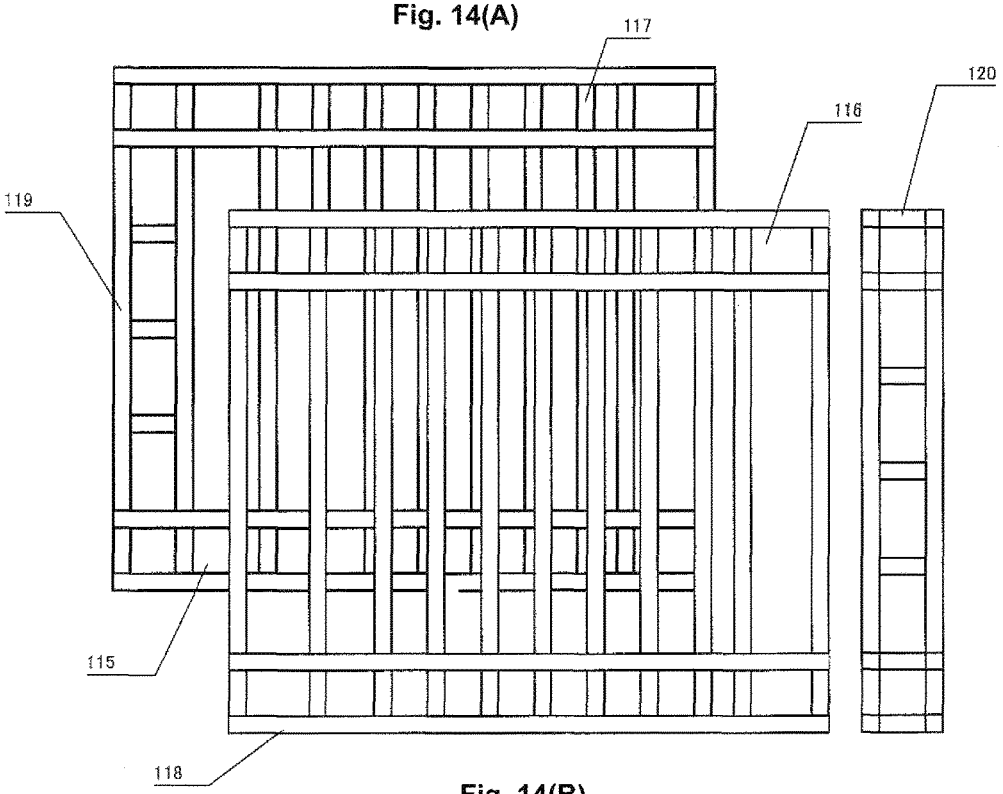
FIG. 14(B) shows a front chart of a Reinforcement Frame Device (121).

FIG. 14(A) shows a plan chart of a Reinforcement Frame Device (121). FIG. 14(B) shows a front chart.

FIG. 14(A) and FIG. 14(B) shows a concept chart of a Reinforcement Frame Device (121). Reinforcement Frame Device (121) is composed of Bottom Frame (115), Top Frame (116), Rear Frame (117), Front Frame (118), Left Side Frame (119) and Right Side Frame (120). These frames are manufactured from steel.

The heat foam resin of the honeycomb cell foams when the honeycomb container tank is heated. Also, the walls of the honeycomb container tank are pushed out outside. The container wall assembly can be destroyed, if there is no Reinforcement Frame Device (121). The heat of the heating oven is never interrupted, because the reinforcement frame is a bone structure.

Figure 15A:
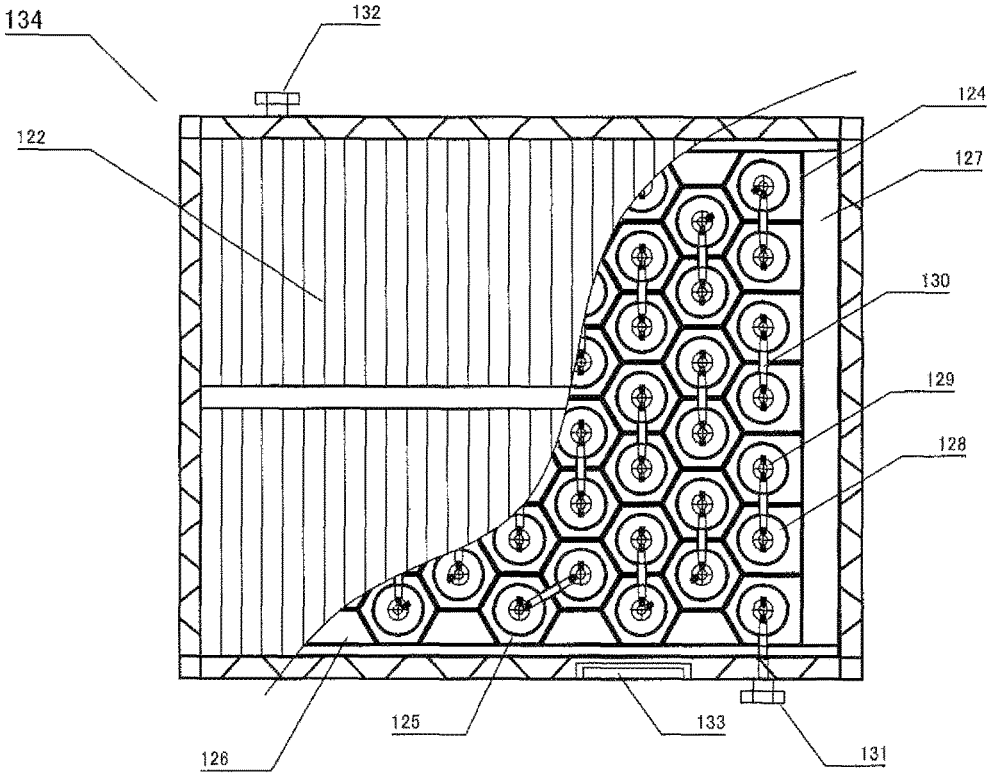
FIG. 15(A) shows a plan chart of a High-Pressure Container Tank (134).
Figure 15B:
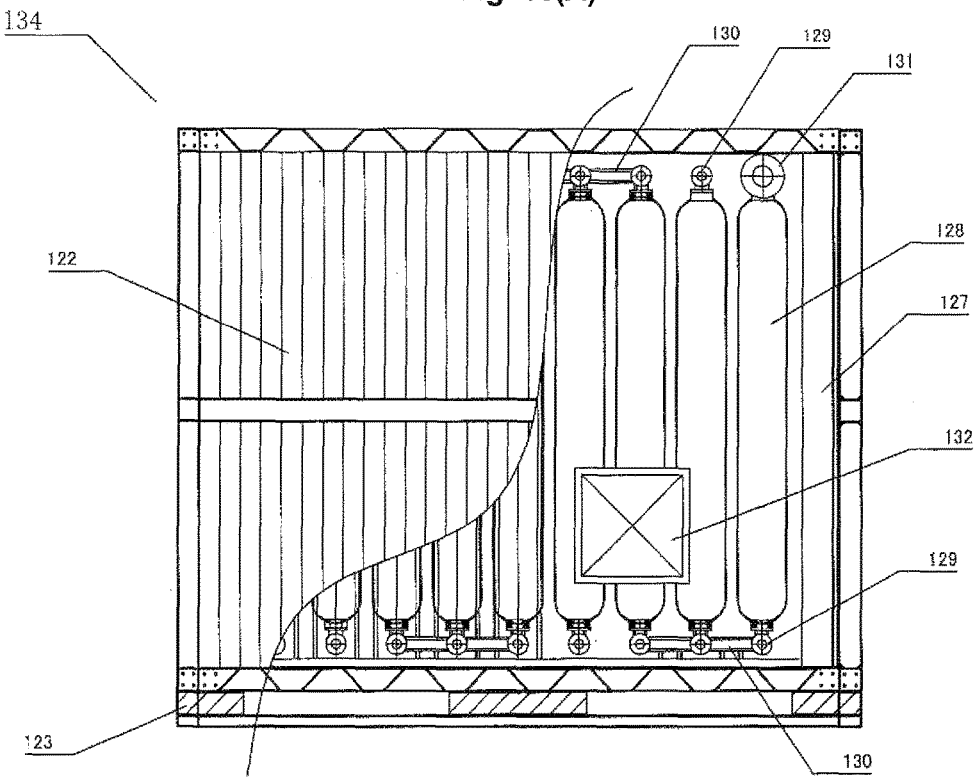
FIG. 15(B) shows a front chart of a High-Pressure Container Tank (134).

FIG. 15(A) shows a plan chart of a High-Pressure Container Tank (134). FIG. 15(B) shows a front chart of a High-Pressure Container Tank (134).

FIG. 15(A) and FIG. 15(B) show a concept chart of a High-Pressure Container Tank (134), High-Pressure Container Tank (134) is composed of Container Wall (122), Container Base Palette (123), Pentagon Honeycomb Cells (124), Hexagon Honeycomb Cells (125), Trapezoid Fillers (126), Cushion Wall (127), Internal Tank (128), Shut Off Valves (129), Internal Tank Piping (130), Entrance Connection (131), Exit Connection (132) and Control Board (133).

High-Pressure Container Tank (134) is an example of honeycomb structural high-pressure set tank, and is designed so that it is accommodated in an ISO ten-foot container. Container Wall (122) is the most outside protection wall of Internal Tank (128) and is hexahedron made of steel. Container Base Palette (123) is welded under High-Pressure Container Tank (134), and transports High-Pressure Container Tank (134) conveniently. Cushion Wall (127)

is manufactured from the heat foam resin and is the second protection of Internal Tanks (128). Pentagon Honeycomb Cells (124), Hexagon Honeycomb Cells (125) and Trapezoid Fillers (126) are manufactured from the heat foam resin. The heat foam resin foams and expands when heated. The outer shells of Pentagon Honeycomb Cells (124), Hexagon Honeycomb Cells (125) and Trapezoid Fillers (126) are made of thermoplastic carbon fiber prepreg or thermoplastic glass fiber prepreg. These outer shells mutually merge by the heat-treatment process, and then the shape of merged shells becomes a honeycomb structure.

The strong honeycomb cell manufactured from carbon fiber or the glass fiber is the third protection of Internal Tanks (128). The honeycomb structure built with carbon fiber or the glass fiber protects Internal Tanks (128) from external shock loading. The heat form resin, which is formed by a heat-treatment process, is the fourth protection of Internal Tanks (128).

Internal Tank (128) is made from plastic and is reinforced by thermosetting carbon fiber prepreg. The reinforcement structure of Internal Tank (128) is designed to endure the high pressure in a single tank alone. All Internal Tanks (128) are enclosed in High-Pressure Container Tank (134). They are connected in series, by Internal Tank Piping (130). Two Shut Off Valves (129) are attached at the top and bottom of each Internal Tank (128). Shut Off Valve (129) is used when High-Pressure Container Tank (134) is manufactured. They need heat proofing, because the Shut Off Valves (129) are heated at heat treatment process, Shut Off Valves (129) are permanently enclosed in High-Pressure Container Tank (134). Shut Off Valve (129) is also used when High-Pressure Container Tank (134) is transported. Control Board (133) controls the opening and shutting of Shut Off Valve (129). Shut Off Valve (129) can minimize a potential disaster due to Internal Tank (128) being damaged accidentally while transporting High-Pressure Container Tank (134). There are Entrance Connection (131) and Exit Connection (132) in High-Pressure Container Tank (134). Entrance Connection (131) and Exit Connection (132) are the connecting ports to the outside.

It will be appreciated that modifications may be made in the present invention. This invention is the one invented to improve U.S. Pat. No. 8,917,809 B2. Manufacturing the large-scale container set tank is difficult by U.S. Pat. No. 8,917,809 B2, because the patent heats the honeycomb cell from the outside. The method of the new invention can be applied to the pillar of a large-scale honeycomb structure. In addition, it is difficult to make a honeycomb cell with high size accuracy by the patent of "U.S. Pat. No. 8,917,809 B2", because the patent manufactures the honeycomb cell with thermosetting prepreg. The method of the new invention can be applied to the rapid-transit railway and the aircraft.

The spirit of this invention is a technical advancement of U.S. Pat. No. 8,917,809 B2 with new manufacturing facilities. For that purpose, this invention developed the manufacturing process for the honeycomb cell with advanced accuracy and on a large scale. Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A high-pressure honeycomb tank container structure, comprising:

a first plurality of cell tanks fixedly arranged adjacent each other;

a second plurality of cell tanks fixedly arranged adjacent each other and along at least a first outer periphery of the first plurality of cell tanks; and a plurality of filler elements fixedly arranged adjacent each other and along at least a second outer periphery of the first plurality of cell tanks so as to occupy voids formed by the adjacent ones of the first plurality of cell tanks in the second outer periphery, each of plurality of filler elements being substantially trapezoid-shaped in cross-section, wherein the first plurality of cell tanks with the second plurality of cell tanks arranged along at least the first outer periphery and the plurality of fillers arranged in the voids along at least the second outer periphery together form a rectangular shaped structure in cross-section, wherein each of at least the first plurality of cell tanks includes a cylindrical storage tank having first and second connection ports operatively connected to top and bottom ends respectively of the cylindrical storage tank, a reinforcement FRP prepreg outer cover wrapped around the cylindrical storage tank, first and second height adaptors operatively connected to the top and bottom ends respectively of the cylindrical storage tank, a foam resin body surrounding the cylindrical storage tank wrapped in the reinforcement FRP prepreg outer cover and the first and second height adaptors, and a prepreg outer shell, the foam resin body and the prepreg outer shell being formed such that each of the first plurality of cell tanks are hexagon-shaped in cross-section, wherein each of the second plurality of cell tanks including a cylindrical storage tank having first and second connection ports operatively connected to top and bottom ends respectively of the cylindrical storage tank, a reinforcement FRP prepreg outer cover wrapped around the cylindrical storage tank, first and second height adaptors operatively connected to the top and bottom ends respectively of the cylindrical storage tank, a foam resin body surrounding the cylindrical storage tank wrapped in the reinforcement FRP prepreg outer cover and the first and second height adaptors, and a prepreg outer shell, the foam resin body and the prepreg outer shell being formed such that each of the second plurality of cell tanks are substantially pentagon-shaped in cross-section.

2. A high-pressure honeycomb tank container structure according to claim 1, wherein each of the plurality of filler elements includes an elongated foam resin body and a prepreg outer shell, and foam resin body and the prepreg outer shell are trapezoid-shaped in cross-section.

3. A high-pressure honeycomb tank container structure according to claim 1, further comprising:

a container wall assembly fixedly connected to surround the rectangular-shaped structure, the container wall assembly including a top wall, a bottom wall, a front wall, a rear wall, a right side wall and a left side wall, each being formed with a flat steel inside plate and an outer corrugated steel plate.

4. A high-pressure honeycomb tank container structure according to claim 1, further comprising:

a container cell assembly fixedly connected to surround the rectangular-shaped structure, the container cell assembly including a bottom wall, a rear wall, and a left side wall, each being formed with a flat steel inside plate and an outer corrugated steel plate, and a rear cushion wall and a left side cushion wall, each formed from heat foam resin.

5. A high-pressure honeycomb tank container structure according to claim 1, further comprising:

a container honeycomb cell assembly fixedly connected to surround the rectangular-shaped structure, the container honeycomb cell assembly including a bottom wall, a rear wall, and a left side wall, each being formed with a flat steel inside plate and an outer corrugated steel plate, and a front cushion wall, a rear cushion wall, a right side cushion wall and a left side cushion wall, each formed from heat foam resin.

6. A high-pressure honeycomb tank container structure according to claim 1, wherein each of the first plurality of cell tanks further includes first and second height adaptors operatively connected to the top and bottom ends respectively of the cylindrical tank.

7. A high-pressure honeycomb tank container structure according to claim 1, wherein each of the second plurality of cell tanks further includes first and second height adaptors operatively connected to the top and bottom ends respectively of the cylindrical tank.

8. A high-pressure honeycomb tank container structure according to claim 1, further comprising:

tank connection piping operatively connecting pairs of the first and second pluralities of cell tanks such that the first and second pluralities of cell tanks are connected in series, wherein each of the first and second pluralities of cell tanks includes a shutoff valve operatively connected to each of the first and second connection ports of the cylindrical storage tank therein, the tank connection piping connecting the shutoff valves between the pairs of the first and second pluralities of cell tanks.

9. A high-pressure honeycomb tank container structure according to claim 1, further comprising:

a reinforcing frame assembly fixedly connected to surround the rectangular-shaped, the reinforcing frame assembly including a top frame, a bottom frame, a front frame, a rear frame, a right side frame and a left side frame.

* * * * *